US011367561B2

(12) United States Patent
Lim et al.

(10) Patent No.: US 11,367,561 B2
(45) Date of Patent: Jun. 21, 2022

(54) COIL COMPONENT

(71) Applicant: SAMSUNG ELECTRO-MECHANICS CO., LTD., Suwon-si (KR)

(72) Inventors: Seung Mo Lim, Suwon-si (KR); Byeong Cheol Moon, Suwon-si (KR); Tai Yon Cho, Suwon-si (KR); Tae Jun Choi, Suwon-si (KR); Jeong Hoon Ryou, Suwon-si (KR); Dong Sik Yoo, Suwon-si (KR); No Il Park, Suwon-si (KR); Seung Hee Oh, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 427 days.

(21) Appl. No.: 16/357,795

(22) Filed: Mar. 19, 2019

(65) Prior Publication Data

US 2020/0035404 A1 Jan. 30, 2020

(30) Foreign Application Priority Data

Jul. 27, 2018 (KR) ..... 10-2018-0087648

(51) Int. Cl.
*H01F 27/29* (2006.01)
*H01F 27/28* (2006.01)

(52) U.S. Cl.
CPC ..... *H01F 27/2885* (2013.01); *H01F 27/29* (2013.01)

(58) Field of Classification Search
CPC .... H01F 27/2885; H01F 27/29; H01F 27/292; H01F 2017/008; H01F 17/0013;
(Continued)

(56) References Cited

U.S. PATENT DOCUMENTS 6,292,139 B1 * 9/2001 Yamamoto ..... H01Q 1/38 343/700 MS
10,121,587 B2 11/2018 Yamada
(Continued)

FOREIGN PATENT DOCUMENTS

CN 1330375 A 1/2002
CN 104916390 A 9/2015
(Continued)

OTHER PUBLICATIONS

Chinese Office Action dated Jan. 6, 2022 , issued in corresponding Chinese Patent Application No. 201910488976.0.

*Primary Examiner* — Mang Tin Bik Lian
(74) *Attorney, Agent, or Firm* — Morgan, Lewis & Bockius LLP

(57) ABSTRACT

A coil component includes a body and a coil portion disposed in the body and including first and second lead-out portions. Recesses are disposed along edges of one surface of the body, and expose the first and second lead-out portions to internal walls and lower surfaces of the recesses. First and second external electrodes are disposed in the recesses, and are connected to the first and second lead-out portions. A third external electrode is disposed in the recesses, and is connected to a connection electrode disposed on side surfaces of the body and on another surface of the body opposite to the one surface. An external insulating layer covers the connection electrode, and has an opening exposing at least a portion of the connection electrode. A shielding layers is disposed on the external insulating layer and in the opening and connects to the connection electrode.

22 Claims, 16 Drawing Sheets

(58) Field of Classification Search
CPC .... H01F 27/366; H01F 17/04; H01F 27/2804; H01F 27/323; H01F 27/363; H01F 2017/002
See application file for complete search history.

(56) References Cited

U.S. PATENT DOCUMENTS

| | | | | |
|---|---|---|---|---|
| 2002/0021191 | A1 | 2/2002 | Naruse et al. | |
| 2004/0233606 | A1* | 11/2004 | Inoue | H02H 9/04 361/118 |
| 2010/0219925 | A1* | 9/2010 | Yamamoto | H01F 41/041 336/199 |
| 2011/0309895 | A1* | 12/2011 | Ahn | H01P 1/20345 333/185 |
| 2012/0073100 | A1* | 3/2012 | Tsutsumi | H01G 4/232 29/25.42 |
| 2013/0250476 | A1* | 9/2013 | Chung | H01G 4/232 361/303 |
| 2015/0048915 | A1* | 2/2015 | Yoon | H01F 17/0013 336/192 |
| 2016/0116284 | A1 | 4/2016 | Shimura et al. | |
| 2016/0172103 | A1 | 6/2016 | Jeong et al. | |
| 2016/0225521 | A1* | 8/2016 | Yamada | H01F 41/0246 |
| 2016/0268038 | A1* | 9/2016 | Choi | H01F 27/255 |
| 2017/0110240 | A1 | 4/2017 | Masuda | |
| 2017/0200682 | A1* | 7/2017 | Lin | H01L 24/97 |
| 2018/0096783 | A1* | 4/2018 | Fukuda | H01F 27/346 |
| 2018/0166211 | A1* | 6/2018 | Takatsuji | H02M 3/156 |
| 2018/0182537 | A1* | 6/2018 | Shimizu | H01F 27/292 |
| 2018/0308630 | A1* | 10/2018 | Shinohara | H01F 27/29 |
| 2020/0020477 | A1 | 1/2020 | Kang et al. | |

FOREIGN PATENT DOCUMENTS

| | | | |
|---|---|---|---|
| CN | 105548597 | A | 5/2016 |
| CN | 105702428 | A | 6/2016 |
| CN | 105845422 | A | 8/2016 |
| CN | 108183017 | A | 6/2018 |
| CN | 110706901 | A | 1/2020 |
| JP | H09-121093 | A | 5/1997 |
| JP | 2005-310863 | A | 11/2005 |
| JP | 2007-165477 | A | 6/2007 |
| JP | 2012-060013 | A | 3/2012 |
| JP | 2017-076796 | A | 4/2017 |
| KR | 10-1998-0042442 | A | 8/1998 |
| KR | 10-2015-0089278 | A | 8/2015 |

* cited by examiner

COIL COMPONENT

CROSS-REFERENCE TO RELATED APPLICATION(S)

This application claims benefit of priority to Korean Patent Application No. 10-2018-0087648 filed on Jul. 27, 2018 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a representative passive electronic component used together with a resistor and a capacitor in electronic devices.

As electronic devices are designed to have higher performance and to be reduced in size, electronic components used in electronic devices have been increased in number and reduced in size.

Accordingly, there has been increasing demand for removing a factor causing noise such as electromagnetic interference (EMI) in electronic components.

A currently used EMI shielding technique is, after mounting electronic components on a substrate, to envelop the electronic components and the substrate with a shielding can.

SUMMARY

An aspect of the present disclosure is to provide a coil component having a reduced size and thickness.

Another aspect of the present disclosure is to provide a coil component in which an electrode structure may easily be formed on a lower surface.

Another aspect of the present disclosure is to provide a coil component in which a shielding structure reducing magnetic flux leakage may easily be formed.

According to an aspect of the present disclosure, a coil component includes a body having one surface and another surface opposing each other, front and rear surfaces connecting the one surface and the other surface and opposing each other, and side surfaces connecting the both front and rear surfaces and opposing each other. A coil portion is disposed in the body, and includes first and second lead-out portions. Recesses are disposed along edges of the one surface of the body, and expose the first and second lead-out portions to internal walls and lower surfaces of the recesses. First and second external electrodes are disposed in the recesses and are spaced apart from each other, and are connected to the first and second lead-out portions, respectively. A third external electrode is disposed in the recesses, and is spaced apart from the first and second external electrodes. A connection electrode is disposed on at least a portion of the side surfaces of the body and on the other surface of the body, and is connected to the third external electrode. An external insulating layer covers the connection electrode, and has an opening exposing at least a portion of the connection electrode. A shielding layer is disposed on the external insulating layer and in the opening and is connected to the connection electrode.

According to another aspect of the present disclosure, a coil component includes a body having first and second surfaces opposing each other in a first direction, third and fourth surfaces opposing each other in a second direction, and fifth and sixth surfaces opposing each other in a third direction. A coil is disposed in the body to be substantially parallel to the first surface and spaced apart from the first surface, and includes first and second lead-out portions connected to respective ends of the coil. Recesses are each disposed along an edge of the first surface and along an edge of a respective one of the third, fourth, fifth, and sixth surfaces of the body. A shielding layer is disposed on second, third, fourth, fifth, and sixth surfaces of the body, and includes at least one of a conductive material and a magnetic material. First, second, and third external electrodes are disposed in the recesses, are connected to the first lead-out portion, the second lead-out portion, and the shielding layer, respectively, and are disposed on the first surface of the body to be spaced apart from each other.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
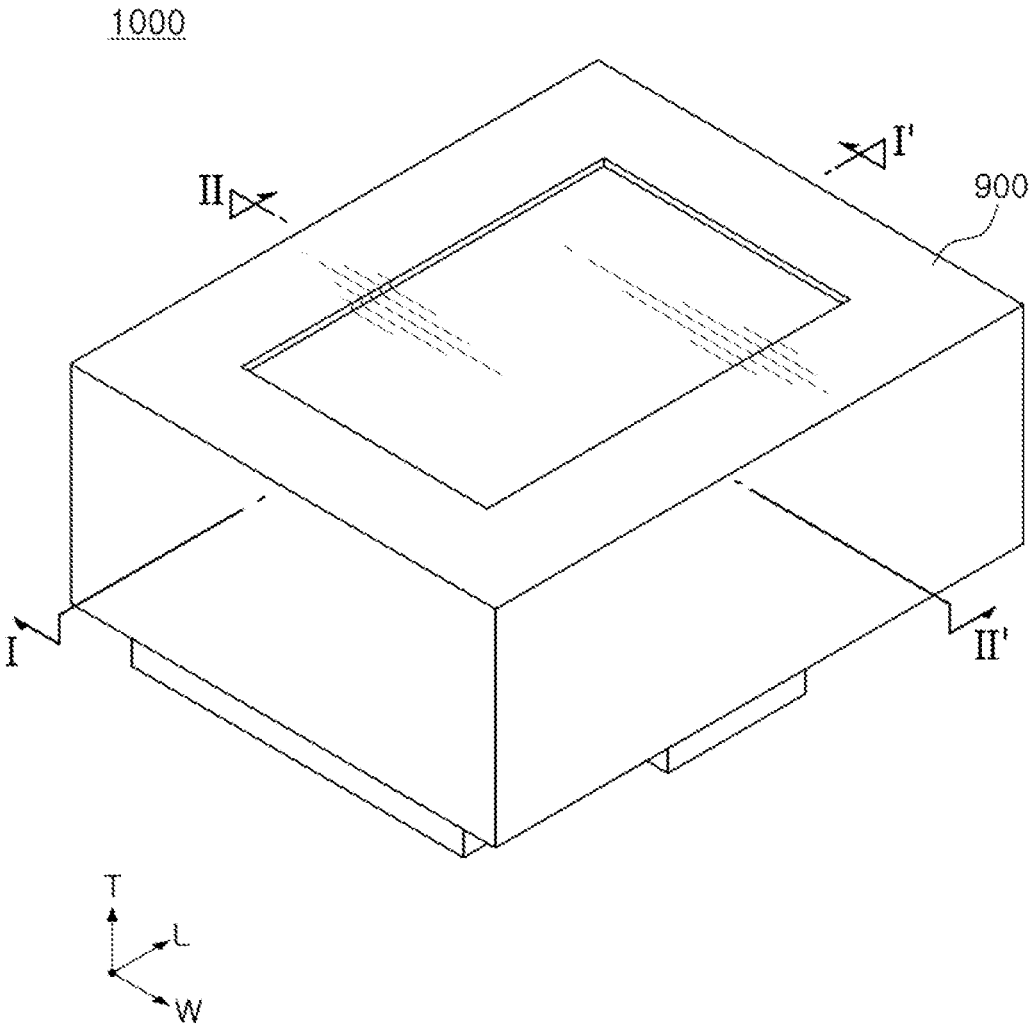
FIG. 1 is a schematic diagram illustrating a coil component according to an exemplary embodiment in the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. The terms, "include," "comprise," "is configured to," etc. in the description are used to indicate the presence of features, numbers, steps, operations, elements, parts, functions, or combination thereof, and do not exclude the possibilities of combination or addition of one or more features, numbers, steps, operations, elements, parts, functions, or combination thereof. Also, the term "disposed on," "positioned on," and the like, may indicate that an element is positioned on or below an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, and a T direction is a third direction or a thickness direction.

In the descriptions described with reference to the accompanying drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
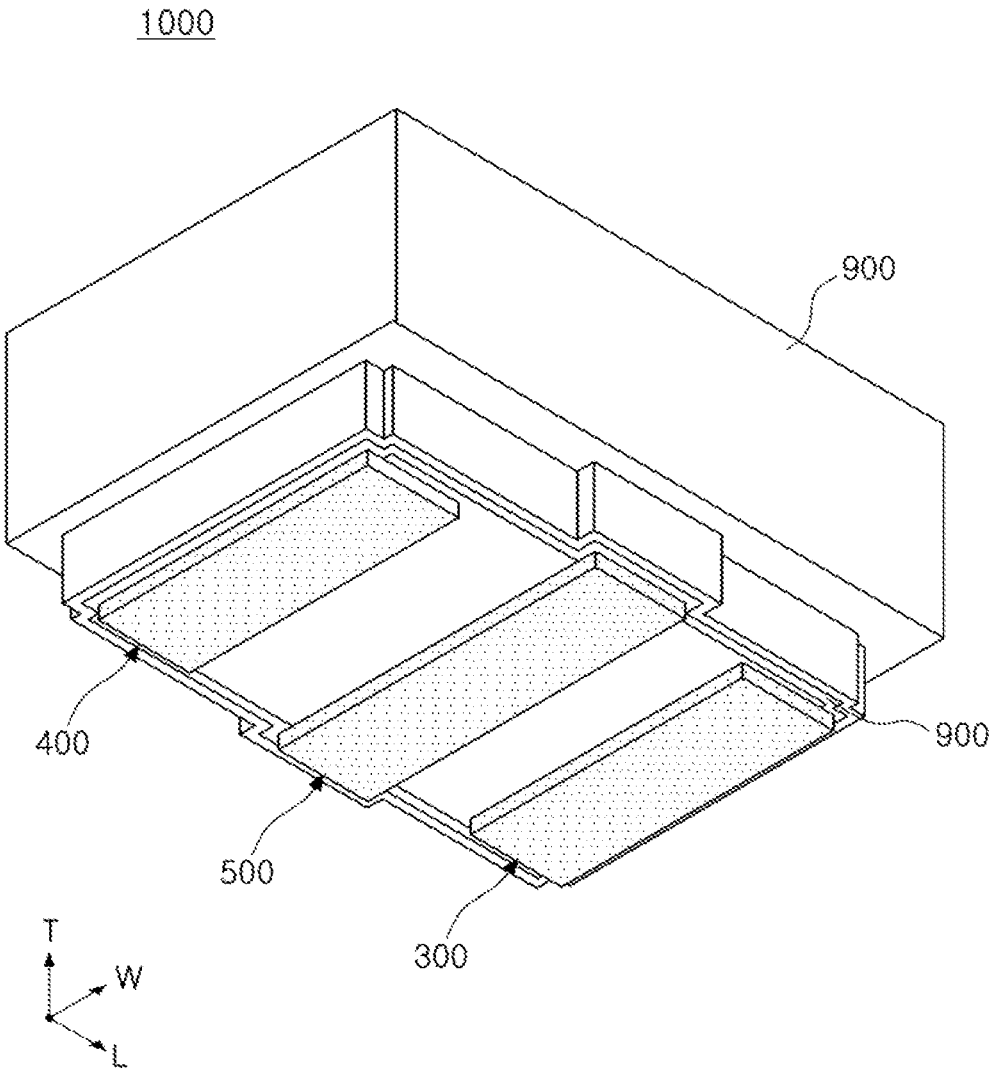
FIG. 2 is a diagram illustrating a coil component illustrated in FIG. 1, viewed from a lower portion direction.
Figure 3:
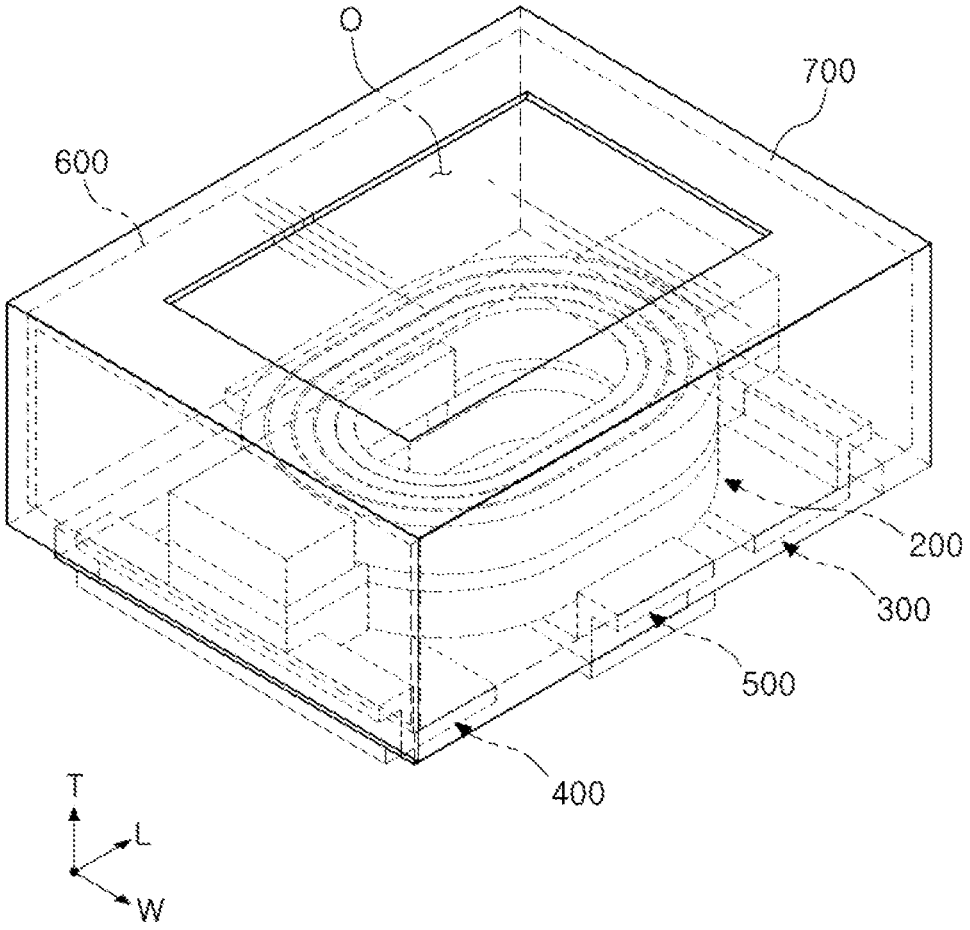
FIG. 3 is a diagram illustrating a coil component in which some of elements illustrated in FIG. 1 are omitted or translucent.
Figure 4:
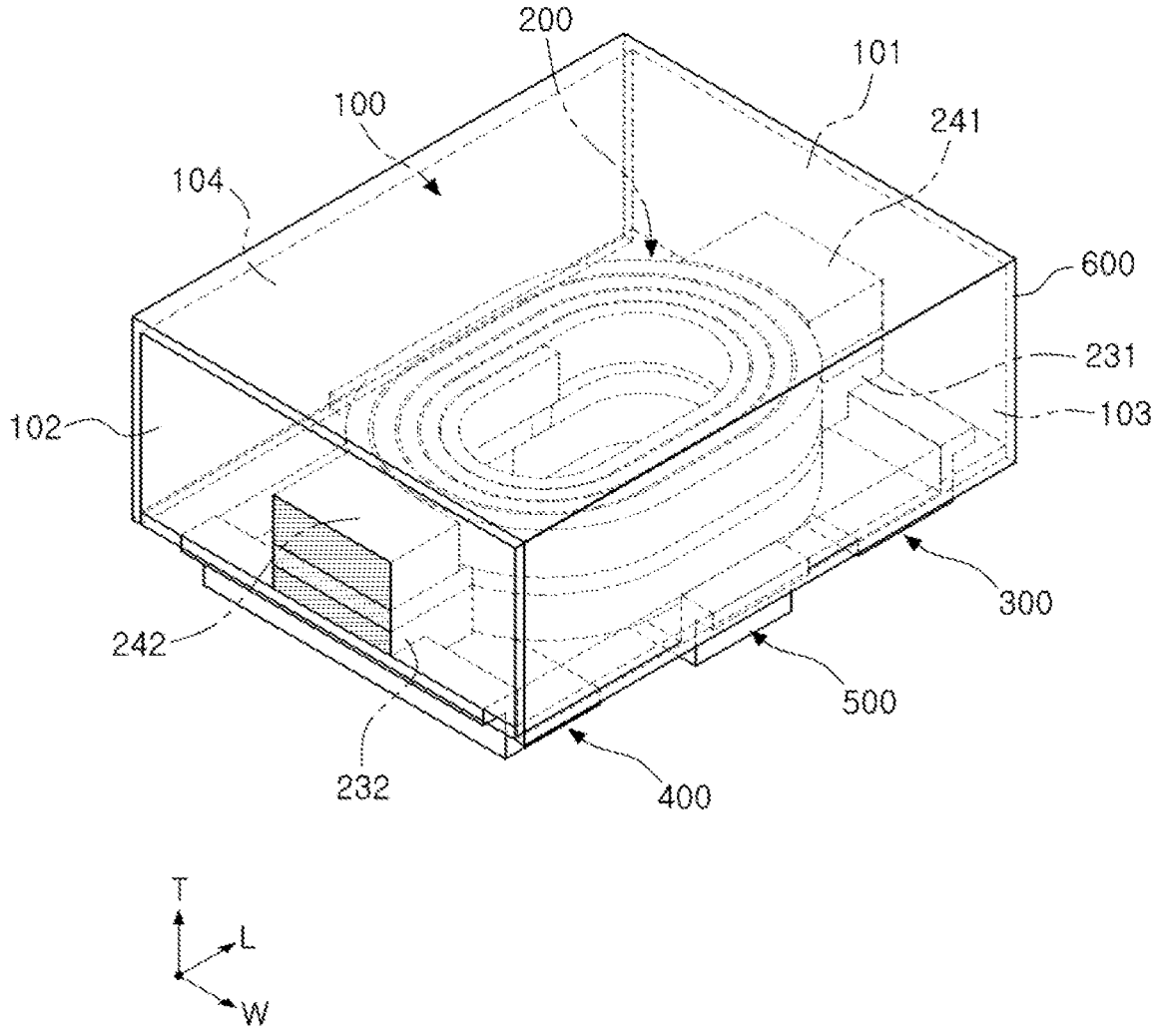
FIG. 4 is a diagram illustrating a coil component in which some of elements illustrated in FIG. 3 are omitted or translucent.

FIG. 1 is a schematic diagram illustrating a coil component according to an exemplary embodiment. FIG. 2 is a diagram illustrating a coil component illustrated in FIG. 1, viewed from a lower portion direction. FIG. 3 is a diagram illustrating a coil component in which some of elements illustrated in FIG. 1 are omitted or translucent. FIG. 4 is a diagram illustrating a coil component in which some of elements illustrated in FIG. 3 are omitted or translucent.

Figure 5:
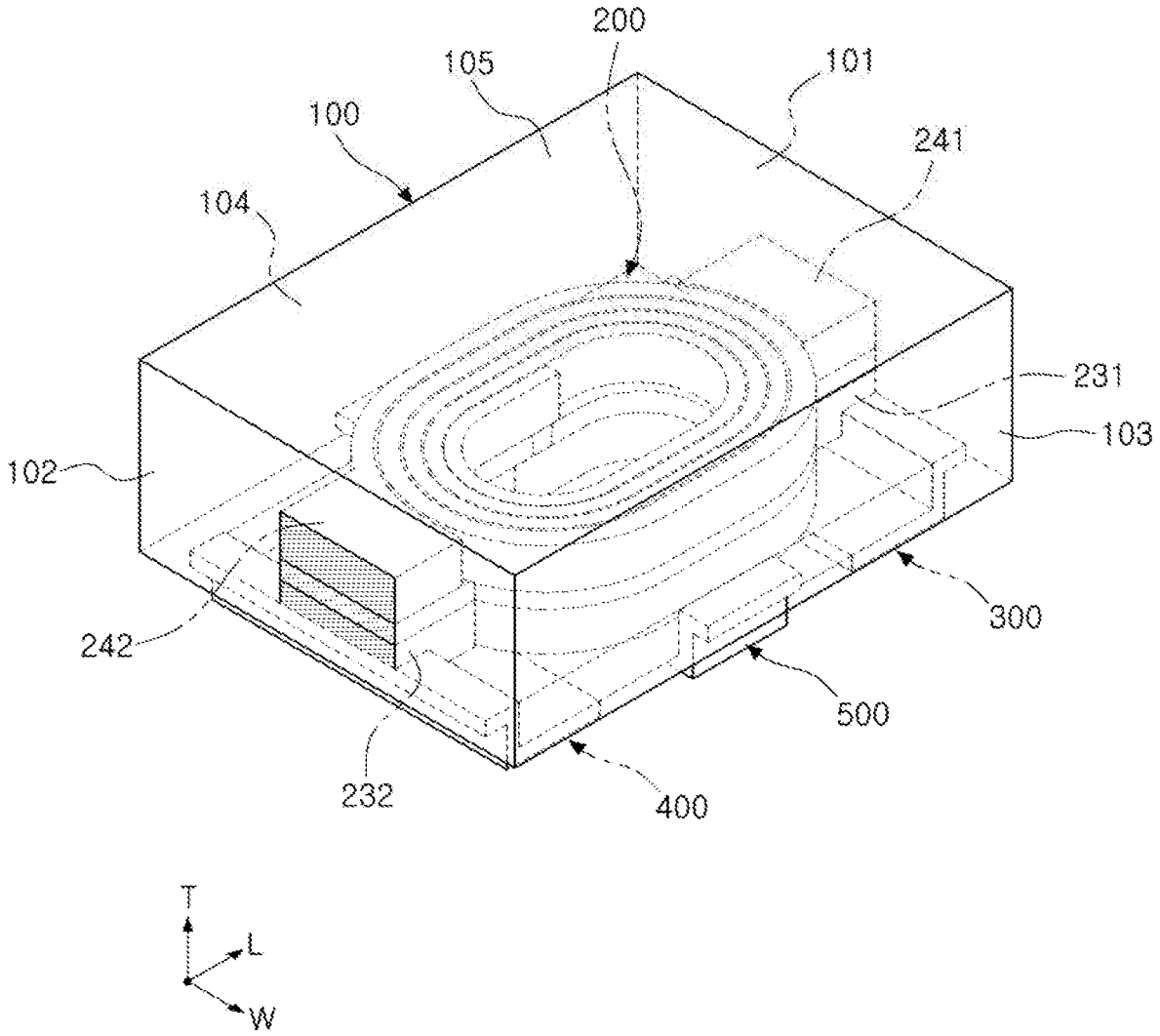
FIG. 5 is a diagram illustrating a coil component in which some of elements illustrated in FIG. 4 are omitted or translucent.
Figure 6:
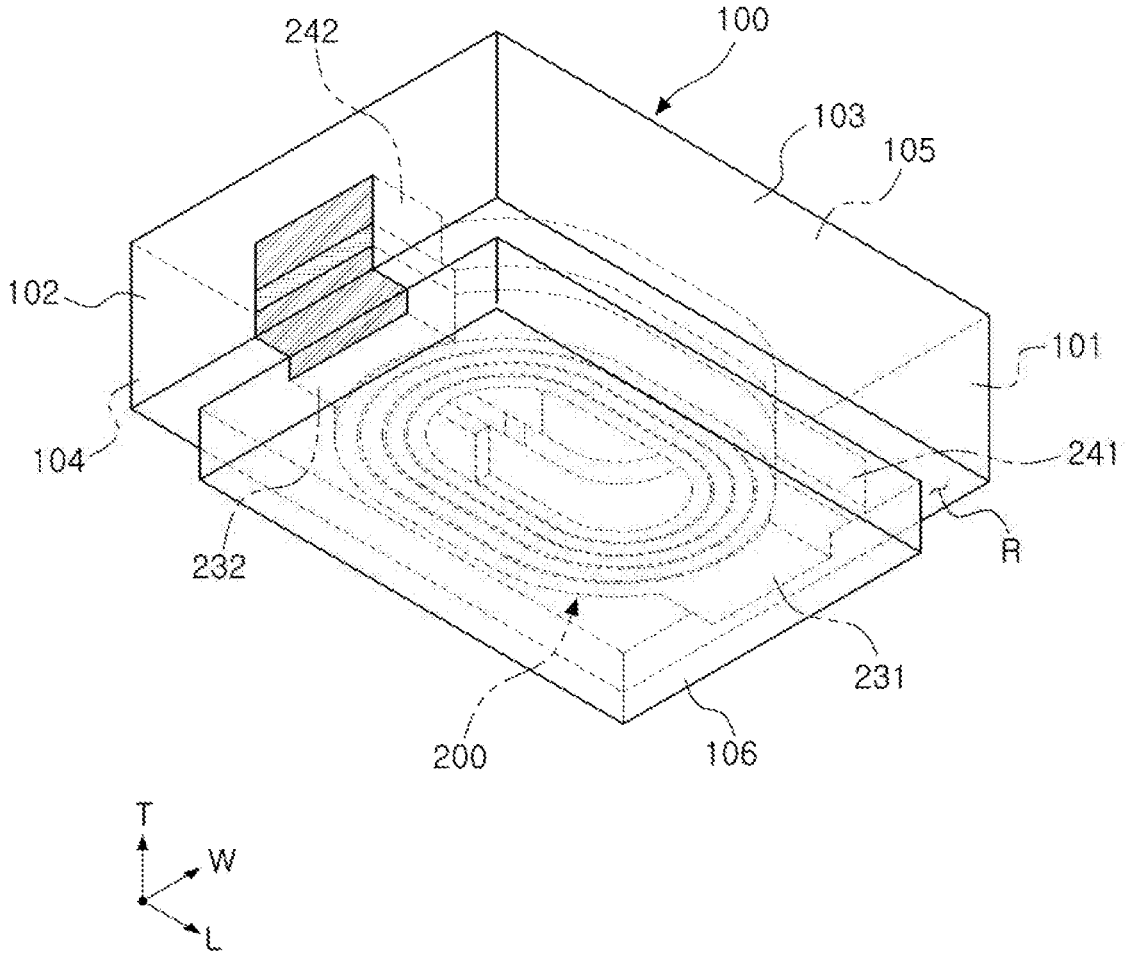
FIG. 6 is a diagram illustrating a coil component in which some of elements illustrated in FIG. 5 are omitted or translucent.
Figure 7:
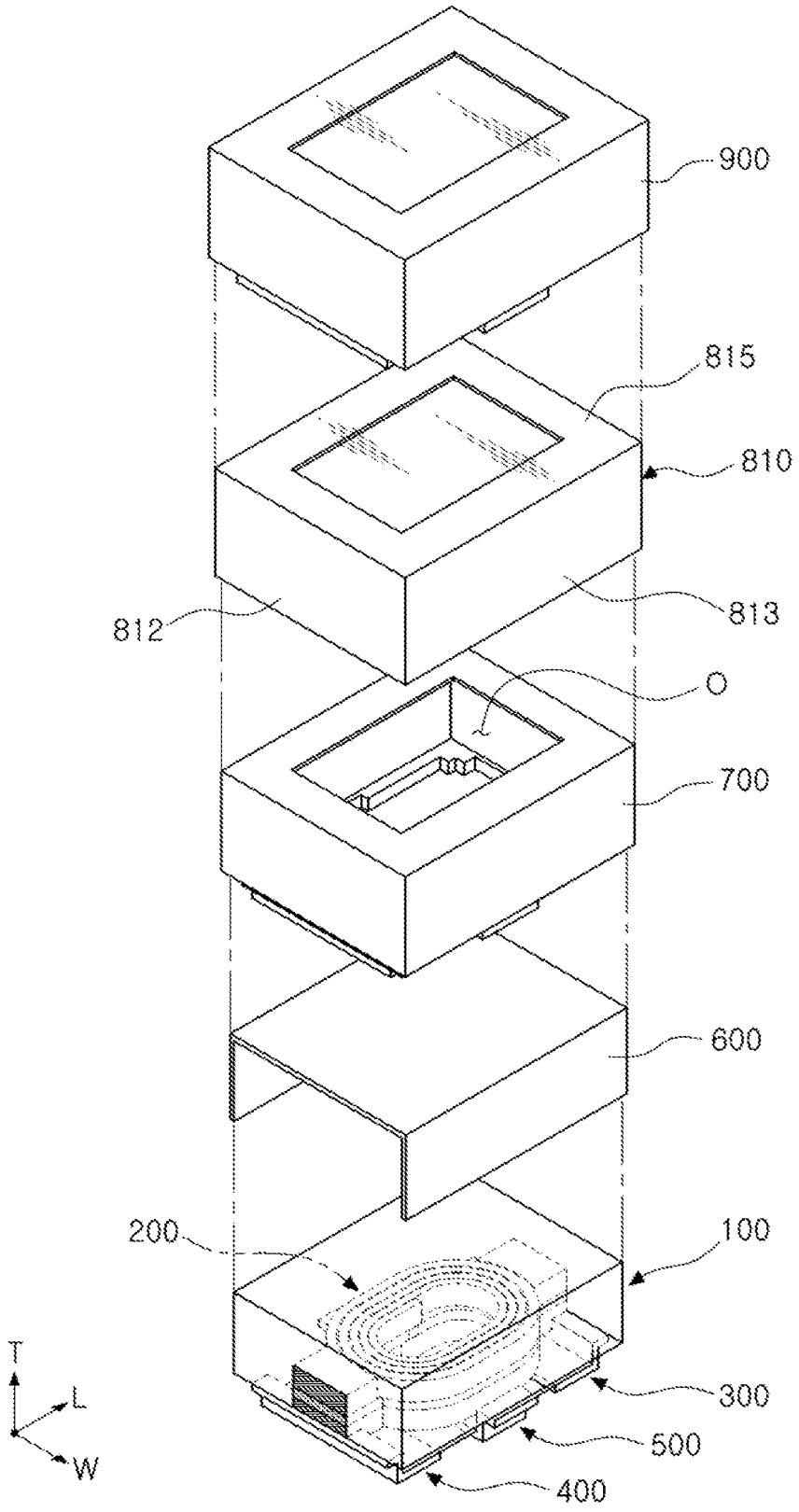
FIG. 7 is an exploded diagram illustrating some of elements of a coil component according to an exemplary embodiment in the present disclosure.
Figure 8:
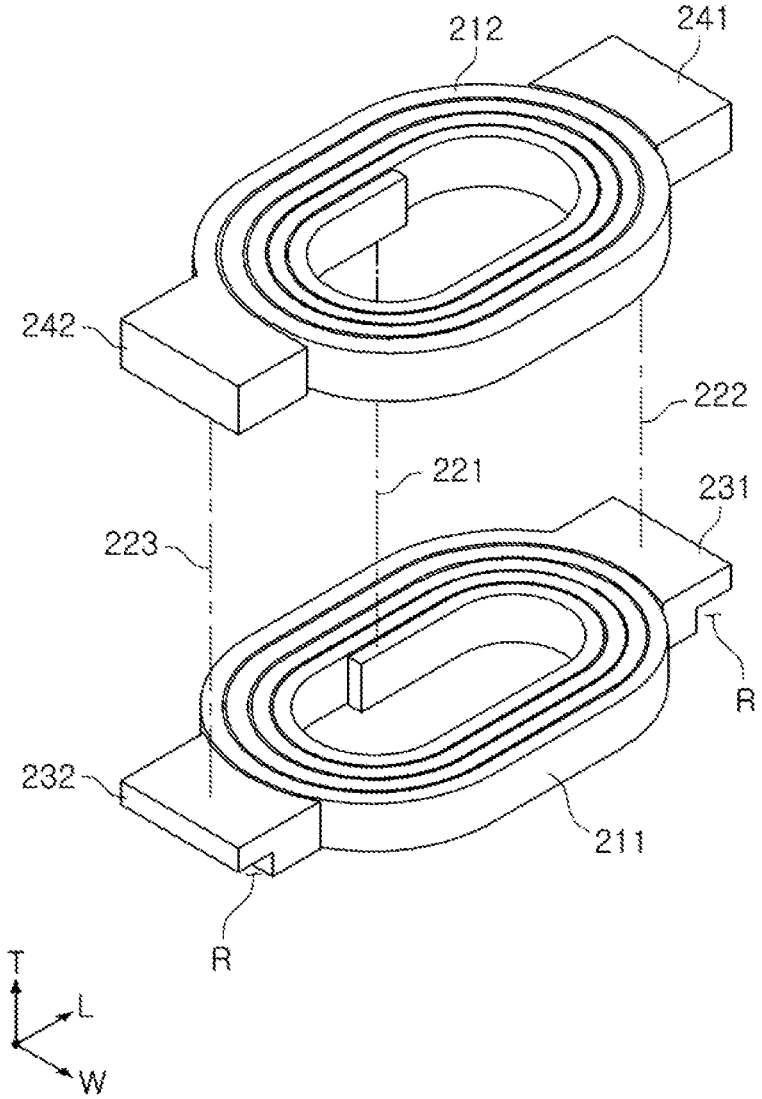
FIG. 8 is an exploded diagram illustrating a coil portion.
Figure 9:
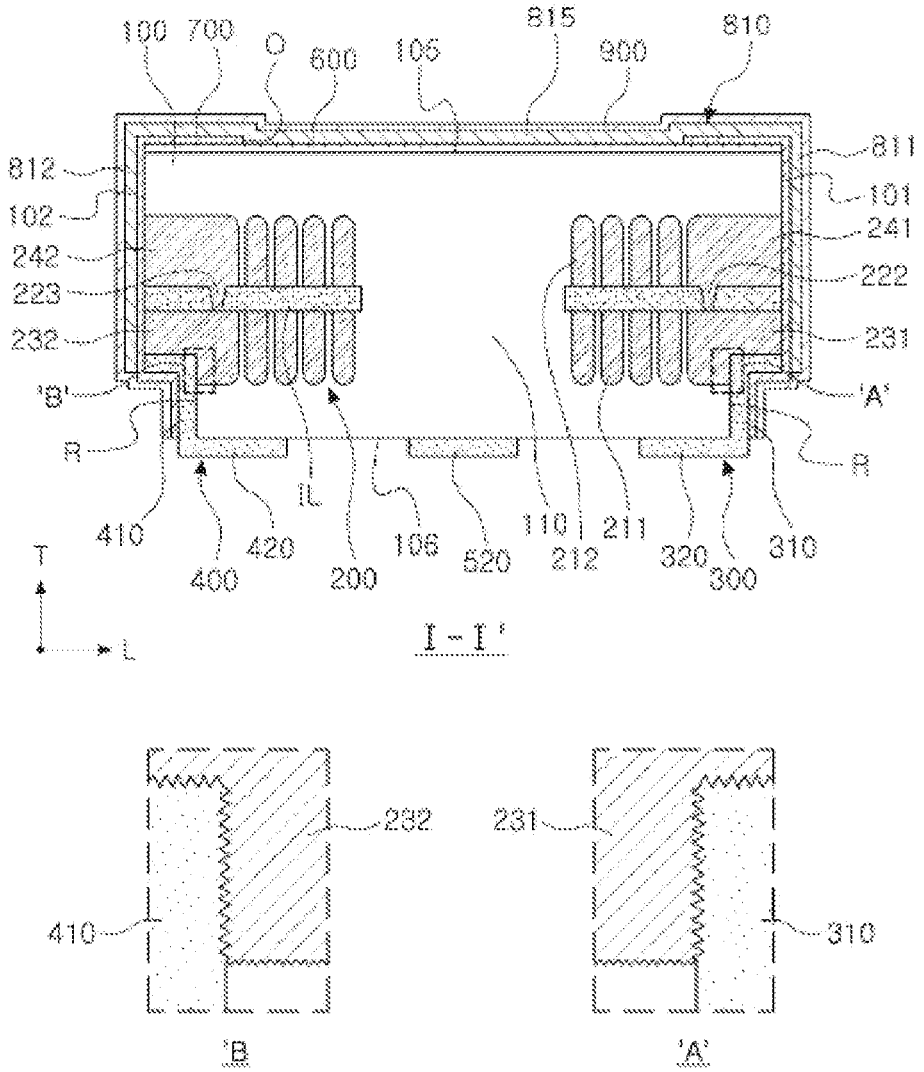
FIG. 9 is a cross-sectional view taken along line I-I' in FIG. 1.
Figure 10:
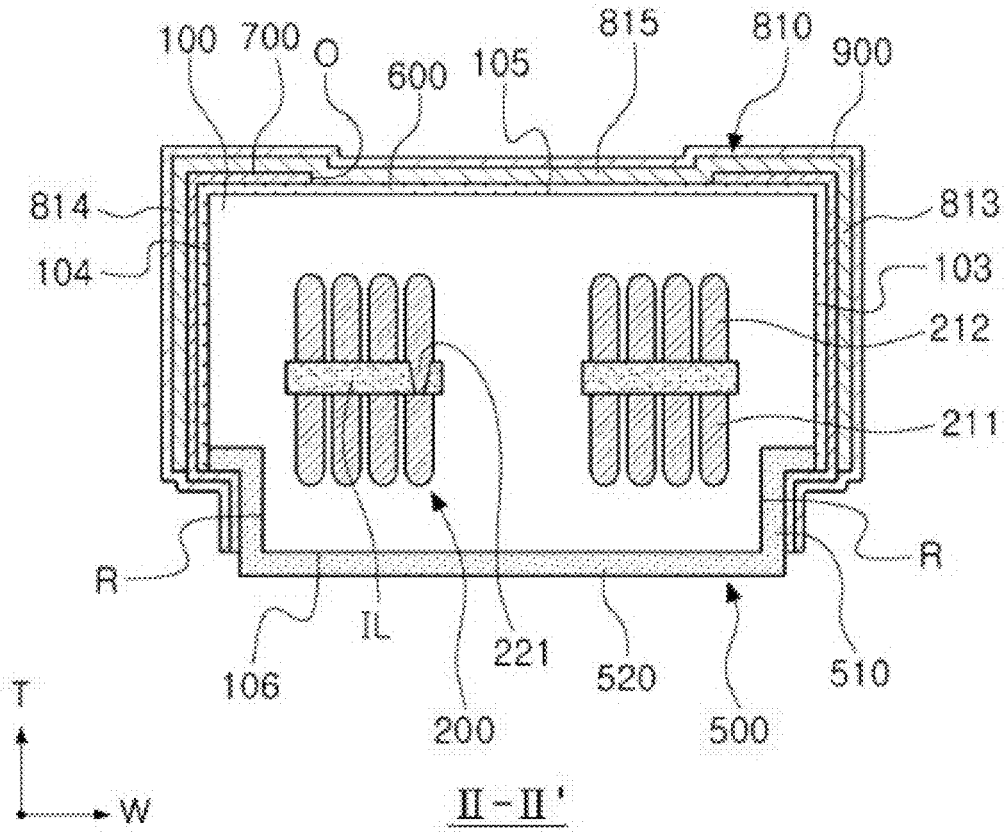
FIG. 10 is a cross-sectional view taken along line II-II' in FIG. 1.

FIG. 5 is a diagram illustrating a coil component in which some of elements illustrated in FIG. 4 are omitted or translucent. FIG. 6 is a diagram illustrating a coil component in which some of elements illustrated in FIG. 5 are omitted or translucent, viewed from a lower portion direction. FIG. 7 is an exploded diagram illustrating some of elements of a coil component. FIG. 8 is an exploded diagram illustrating a coil portion. FIG. 9 is a cross-sectional diagram taken along line I-I' in FIG. 1. FIG. 10 is a cross-sectional diagram taken along line II-II' in FIG. 1.

With regard to the diagrams, FIG. 3 illustrates a coil component illustrated in FIG. 1, where a shielding layer and a cover layer are omitted or translucent. FIG. 4 illustrates a coil component illustrated in FIG. 3, where an insulating layer is omitted or translucent. FIG. 5 illustrates a coil component illustrated in FIG. 4, where a connection electrode is omitted or translucent. FIG. 6 illustrates a coil component illustrated in FIG. 5, where an external electrode is omitted or translucent.

Referring to FIGS. 1 to 10, a coil component 1000 according to the exemplary embodiment may include a body 100, recesses R, a coil portion 200, external electrodes 300, 400, and 500, a connection electrode 600, an external insulating layer 700, and a shielding layer 810, and may further include a cover layer 900 and an internal insulating layer IL.

The body 100 may form an exterior of the coil component 1000, and may bury the coil portion 200 in the body 100.

The body 100 may have a hexahedral shape.

Referring to FIGS. 1, 2, and 4, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body.

As an example, the body 100 may be configured such that the coil component 1000 in which the external electrodes 300, 400, and 500, the external insulating layer 700, the shielding layer 810, and the cover layer 900 are formed may have a length of 2.0 mm, a width of 1.2 mm, and a thickness of 0.65 mm, but an exemplary embodiment of the coil component 1000 is not limited thereto.

The body 100 may include a magnetic material and a resin material. For example, the body 110 may be formed by layering one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

The ferrite and the magnetic metal powder may have an average diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, a crystallinity, and a form of one magnetic material is different from those of the other magnetic material (s).

The resin may include one of an epoxy, a polyimide, a liquid crystal polymer, or mixture thereof, but the example of the resin is not limited thereto.

The body 100 may include a core 110 penetrating through the coil portion 200. The core 110 may be formed by filling a through hole of the coil portion 200 with a magnetic composite sheet, but an exemplary embodiment thereof is not limited thereto.

The recesses R may be formed to surround the first to fourth surfaces 101, 102, 103, and 104 of the body 100 along the sixth surface 106 of the body 100. In other words, the recesses R may be formed along the edge regions formed by the first to fourth surfaces 101, 102, 103, and 104 of the body 100 and the sixth surface 106 of the body 100. For example, the recesses R may be formed along edges at which planar extensions of the first to fourth surfaces 101, 102, 103, and 104 of the body 100 intersect with a planar extension of the sixth surface 106 of the body 100. The recesses R may not extend to the fifth surface 105 of the body 100. In other words, the recesses R may not penetrate through the body 100 in a thickness direction of the body 100 and may thus be spaced apart from and not come into contact with the fifth surface 105.

The recesses R may be formed by pre-dicing a boundary (a dicing line or a singulation line) between the bodies 100 on one surface of a primary coil bar. A width of a pre-dicing tip used in the pre-dicing may be greater than a width of a dicing line of the primary coil bar. The primary coil bar may refer to a state in which a plurality of bodies 100 are connected to each other in a length direction and a width direction of the body 100. The depth of the pre-dicing may be adjusted such that portions of the lead-out portions 231 and 232 may be removed along with a portion of the body 100. In other words, the depth may be adjusted such that the lead-out portions 231 and 232 may be exposed to lower surfaces and internal walls of the recesses R.

The internal walls and the lower surfaces of the recesses R may also form outer surfaces of the body 100. In the exemplary embodiment, however, the internal walls and the lower surfaces of the recesses R may be distinguished from the surfaces of the body 100. The internal walls of the recesses may refer to walls of the recesses that are parallel to the first to fourth surfaces 101, 102, 103, and 104 of the body 100, and the lower surfaces of the recesses R may refer to surfaces of the recesses that are parallel to the sixth surface 106 of the body 100.

The internal insulating layer IL may be buried in the body 100. The internal insulating layer IL may support the coil portion 200.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, Ajinomoto Build-up Film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 200. When the internal insulating layer IL is formed of an insulating material including a photosensitive insulating resin, the number of processes for forming the coil portion 200 may be reduced such that manufacturing costs may be reduced, and a fine via may be formed.

The coil portion 200 may be buried in the body 100, and may embody properties of the coil component. For example, when the coil component 1000 is used as a power inductor, the coil portion 200 may store an electric field as a magnetic field such that an output voltage may be maintained, thereby stabilizing power of an electronic device.

The coil portion 200 may include coil patterns 211 and 212, lead-out portions 231 and 232, auxiliary lead-out portions 241 and 242, and vias 221, 222, and 223.

Referring to FIGS. 9 and 10, the first coil pattern 211, the first lead-out portion 231, and the second lead-out portion 232 may be disposed on a lower surface of the internal insulating layer IL opposing or facing the sixth surface 106 of the body 100, and the second coil pattern 212, the first auxiliary lead-out portion 241, and the second auxiliary lead-out portion 242 may be disposed on an upper surface of the internal insulating layer IL opposing the lower surface of the internal insulating layer IL.

Referring to FIGS. 8 to 10, the first coil pattern 211 may be in contact with and connected to the first lead-out portion 231, and the first coil pattern 211 and the first lead-out portion 231 may be spaced apart from the second lead-out portion 232, on the lower surface of the internal insulating layer IL. Also, the second coil pattern 212 may be in contact with and connected to the second auxiliary lead-out portion 242, and the second coil pattern 212 and the second auxiliary lead-out portion 242 may be spaced apart from the first auxiliary lead-out portion 241, on the upper surface of the internal insulating layer IL. Also, the first via 221 may penetrate through the internal insulating layer IL and may be in contact with the first coil pattern 211 and the second coil pattern 212, the second via 222 may penetrate through the internal insulating layer IL and may be in contact with the first lead-out portion 231 and the first auxiliary lead-out portion 241, and the third via 223 may penetrate through the internal insulating layer IL and may be in contact with the second lead-out portion 232 and the second auxiliary lead-out portion 242. Accordingly, the coil portion 200 may function as a single coil.

The first coil pattern 211 and the second coil pattern 212 each may have a planar spiral shape forming at least one turn centered on the core 110 as an axis. For example, the first coil pattern 211 may form at least one turn on a lower surface of the internal insulating layer IL centered on the core 110 as an axis.

The lead-out portions 231 and 232 may respectively be exposed to lower surfaces and internal walls of the recesses R. During a process for forming the recesses R, portions of the lead-out portions 231 and 232 may be removed along with a portion of the body 100. In other words, the recesses R may respectively extend to the first lead-out portion 231 and the second lead-out portion 232. Accordingly, the first and second external electrodes 300 and 400 may be formed on the lead-out portions 231 and 232 exposed to the lower surfaces and the internal walls of the recesses R, and the coil portion 200 may thereby be connected to the first and second external electrodes 300 and 400.

Surfaces of the lead-out portions 231 and 232 exposed to internal walls and lower surfaces of the recesses R may have surface roughness higher than surface roughness of the other surfaces of the lead-out portions 231 and 232. For example, when the lead-out portions 231 and 232 are formed through a plating process, and the recesses R are formed by the pre-dicing described above, portions of the lead-out portions 231 and 232 may be removed by a dicing tip. Accordingly, the surfaces of the lead-out portions 231 and 232 exposed to the internal walls and the lower surfaces of the recesses R may have higher surface roughness than surface roughness of the other surfaces of the lead-out portions 231 and 232, as a result of the action of a grinding process of the dicing tip. The external electrodes 300 and 400 may be formed as thin films such that cohesion force between the external electrodes 300 and 400 and the body 100 may be weakened. However, as the external electrodes 300 and 400 are in contact with and connected to the one surfaces of the lead-out portions 231 and 232 having relatively high surfaces roughness, cohesion force between the external electrodes 300 and 400 and the lead-out portions 231 and 232 may improve.

In the exemplary embodiment, the lead-out portions 231 and 232 and the auxiliary lead-out portions 241 and 242 may each be exposed to one of the front and rear surfaces 101 and 102 of the body 100. In particular, the first lead-out portion 231 may be exposed to the first surface 101 of the body 100, and the second lead-out portion 232 may be exposed to the second surface 102 of the body 100. Also, the first auxiliary lead-out portion 241 may be exposed to the first surface 101 of the body 100, and the second auxiliary lead-out portion 242 may be exposed to the second surface 102 of the body 100. Accordingly, the first lead-out portion 231 may consecutively be exposed to an internal wall of the recesses R, a lower surface of the recesses R, and the first surface 101 of the body 100, and the second lead-out portion 232 may consecutively be exposed to an internal wall of the recesses R, a lower surface of the recesses R, and the second surface 102 of the body 100.

At least one of the coil patterns 211 and 212, the vias 221, 222, and 223, the lead-out portions 231 and 232, and the auxiliary lead-out portions 241 and 242 may include at least one or more conductive layers.

For example, when the second coil pattern 212, the vias 221, 222, and 223, and the auxiliary lead-out portions 241 and 242 are formed on the other surface of the internal insulating layer IL through a plating process, the second coil pattern 212, the vias 221, 222, and 223, and the auxiliary lead-out portions 241 and 242 each may include a seed layer such as an electroless plating layer, and an electroplating layer. The electroless plating layer may have a single-layer structure, or may have a multilayer structure. The electroplating layer having a multilayer structure may have a conformal film structure in which one of the electroplating layers is covered by the other electroplating layer, or may have a form in which one of the electroplating layers is disposed on one surface of the other plating layers. The seed layer of the second coil pattern 212, the seed layers of the vias 221, 222, and 223, and the seed layers of the auxiliary lead-out portions 241 and 242 may be integrated with one another such that no boundary may be formed therebetween, but an exemplary embodiment thereof is not limited thereto. The electroplating layer of the second coil pattern 212, the electroplating layers of the vias 221, 222, and 223, and the electroplating layers of the auxiliary lead-out portions 241 and 242 may be integrated with one another such that no boundary may be formed therebetween, but an exemplary embodiment thereof is not limited thereto.

As another example, referring to the directions in FIGS. 1 to 6, when the first coil pattern 211 and the lead-out portions 231 and 232 disposed on a lower surface of the internal insulating layer IL, and the second coil pattern 212 and the auxiliary lead-out portions 241 and 242 disposed on an upper surface of the internal insulating layer IL are formed independently, and the coil portion 200 is formed by layering the first coil pattern 211, the lead-out portions 231 and 232, the second coil pattern 212, and the auxiliary lead-out portions 241 and 242 on the internal insulating layer IL, the vias 221, 222, and 223 may include a metal layer having a high melting point, and a metal layer having a low melting point relatively lower than the melting point of the metal layer having a high melting point. The metal layer having a low melting point may be formed of a solder including lead (Pb) and/or tin (Sn). The metal layer having a low melting point may have at least a portion melted due to pressure and temperature generating during the layer process, and an inter-metallic compound layer (IMC layer) may be formed on a boundary between the metal layer having a low melting point and the second coil pattern 212, for example.

As illustrated in FIGS. 9 and 10, the coil patterns 211 and 212, the lead-out portions 231 and 232, and the auxiliary lead-out portions 241 and 242 may be formed on and protrude from a lower surface and an upper surface of the internal insulating layer IL. As another example, the first coil pattern 211 and the lead-out portions 231 and 232 may be formed on and protrude from the lower surface of the internal insulating layer IL, and the second coil pattern 212 and the auxiliary lead-out portions 241 and 242 may be buried in the upper surface of the internal insulating layer IL, and the upper surfaces of the second coil pattern 212 and the auxiliary lead-out portions 241 and 242 may be exposed to the upper surface of the internal insulating layer IL. In this case, concave portions may be formed on the upper surface of the second coil pattern 212 and/or the upper surfaces of the auxiliary lead-out portions 241 and 242 such that the upper surface of the internal insulating layer IL may not be coplanar with the upper surface of the second coil pattern 212 and/or the upper surfaces of the auxiliary lead-out portions 241 and 242.

The coil patterns 211 and 212, the lead-out portions 231 and 232, the auxiliary lead-out portions 241 and 242, and the vias 221, 222, and 223 each may be formed of a conductive material such as aluminum (Al), silver (Ag), tin (Sn), gold (Au), nickel (Ni), lead (Pb), titanium (Ti), or alloys thereof, but an example of the material is not limited thereto.

Referring to FIG. 8, the first auxiliary lead-out portion 241 may be irrelevant to electrical connections between the other components, and the first auxiliary lead-out portion 241 may thus be omitted. However, to omit the process for distinguishing the fifth surface 105 and the sixth surface 106 of the body 100 from each other, it may be desirable to provide the first auxiliary lead-out portion 241.

The external electrodes 300, 400, and 500 may respectively include connection portions 310, 410, and 510 disposed in the recesses R, and pad portions 320, 420, and 520 disposed on the sixth surface 106 of the body 100. The external electrodes 300, 400, and 500 may be spaced apart from one another. The first external electrode 300 may be electrically connected to the second external electrode 400 through the coil portion 200, but the first external electrode 300 and the second external electrode 400 may be spaced apart from each other on the body 100 and the recesses R. The third external electrode 500 may be spaced apart from the first and second external electrodes 300 and 400 and may not be electrically connected to the first and second external electrodes 300 and 400.

The first external electrode 300 may include the first connection portion 310 disposed in a region among internal walls and lower surfaces of the recesses R in which the first lead-out portion 231 is exposed and may thus be in contact with and connected to the first lead-out portion 231, and the first pad portion 320 extends from the first connection portion 310 to the sixth surface 106 of the body 100. The second external electrode 400 may include the second connection portion 410 disposed in a region among internal walls and lower surfaces of the recesses R in which the second lead-out portion 232 is exposed and may thus be in contact with and connected to the second lead-out portion 232, and the second pad portion 420 extends from the second connection portion 410 to the sixth surface 106 of the body 100. The third external electrode 500 may include the third connection portion 510 disposed in a region among internal walls and lower surfaces of the recesses R in which the lead-out portions 231 and 232 are not exposed, and the third pad portion 520 may extend from the third connection portion 510 to the sixth surface 106 of the body 100.

The external electrodes 300, 400, and 500 may each be formed along lower surfaces of the recesses R, internal walls of the recesses R, and the sixth surface 106 of the body 100. In other words, the external electrodes 300, 400, and 500 each may be formed as a conformal film. The external electrodes 300, 400, and 500 may be formed in integrated form on lower surfaces of the recesses R, internal walls of the recesses R, and the sixth surface 106 of the body 100. In other words, the connection portions 310, 410, and 510 and the pad portions 320, 420, and 520 may be formed together through the same process and may be formed in integrated form. The external electrodes 300, 400, and 500 may be formed through a thin film process such as a sputtering process.

The external electrodes 300, 400, and 500 may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto. The external electrodes 300, 400, and 500 may be formed of a single layer or multiple layers. For example, the external electrodes 300, 400, and 500 may respectively further include plating layers formed through a plating process on the pad portions 320, 420, and 520. The plating layer may be provided as a plurality of plating layers, or may be a single layer.

The first and second external electrodes 300 and 400 may be signal electrodes, and the third external electrode may be a ground electrode. When the coil component 1000 is mounted on a printed circuit board, the third external electrode 500 may be electrically connected to a ground layer of the printed circuit board. Thus, the third external electrode 500 may transfer electrical energy generated from the shielding layer 810 to a printed circuit board.

The connection electrode 600 may be disposed on at least portions of the third and fourth surfaces 103 and 104 of the body 100 and on the fifth surface 105 of the body 100, and may be connected to the third external electrode 500.

In the exemplary embodiment, the connection electrode 600 may be over all areas of the third to fifth surfaces 103, 104, and 105 of the body 100. Portions of the connection electrode 600 respectively formed on the third and fourth surfaces 103 and 104 of the body 100 may be in contact with and connected to the third connection portion 510. The connection electrode 600 may not be formed on the first and second surfaces 101 and 102 of the body 100 and the sixth surface 106 of the body 100 to prevent electrical shorts among the external electrodes 300, 400, and 500.

The connection electrode 600 may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto. The connection electrode 600 may a single-layer structure, or may have a multilayer structure. The connection electrode 600 may be formed through a thin film process such as a vapor deposition process.

As an example, the connection electrode 600 may be formed by, after forming a metal layer for forming a connection electrode on a plurality of secondary coil bars formed by performing a primary dicing of a primary coil bar, performing a secondary dicing of the secondary coil bar. The secondary coil bar may be formed by performing the primary dicing process to penetrate through the primary coil bar along a plurality of boundaries of the primary coil bar parallel to a length direction of the body 100. In other words, only one body 100 may be present on one of the secondary coil bars in a width direction, and a plurality of bodies 100 may be connected to each other in respective length directions of the bodies 100 in a length direction. Accordingly, when the secondary dicing of the secondary coil bar is performed along a width direction, the secondary coil bar may be divided into individual bodies 100 and the connection electrode 600 may be only disposed on the third to fifth surfaces 103, 104, and 105 of the individual body 100. As a result, the connection electrode 600 may not be disposed on the first and second surfaces 101 and 102 of the body 100. In the above described example, a width of a primary dicing tip used in the primary dicing process and a width of a secondary dicing tip used in the secondary dicing process may be smaller than a width of a free dicing tip described above.

The external insulating layer 700 may cover the connection electrode 600 and may have an opening O exposing at least a portion of the connection electrode 600.

The external insulating layer 700 may include at least one of a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and SiOx or SiNx.

The external insulating layer 700 may be formed by applying a liquid insulating resin on the body 100, by layering an insulating film such as a dry film (DF) on the body 100, or by forming an insulating material on the body 100 and on the connection portions 310 and 410 through a vapor deposition process. When an insulating film is used, an Ajinomoto Build-up Film (ABF) which does not include a photosensitive insulating resin, or a polyimide film may be used.

In the exemplary embodiment, the external insulating layer 700 may be disposed on the first to fifth surfaces 101, 102, 103, 104, and 105 of the body 100 to cover the connection electrode 600, and may extend onto lower surfaces and internal walls of the recesses R. Accordingly, the external insulating layer 700 may be in contact with and cover the connection electrode 600, the first and second surfaces 101 and 102 of the body 100, and the connection portions 310, 410, and 510 of the external electrodes 300, 400, and 500.

The external insulating layer 700 may have a thickness of 10 nm to 100 μm. When a thickness of the external insulating layer 700 is less than 10 nm, properties of a coil component such as a Q factor may reduce, and when a thickness of the external insulating layer 700 is greater than 100 μm, an overall length, width, and thickness of the coil component may increase such that it may be difficult to reduce a size of the coil component.

The opening O may be formed on the external insulating layer 700 to expose at least a portion of the connection electrode 600 therethrough. The shielding layer 810 may be formed on the external insulating layer 700, and the shielding layer 810 may be in contact with the connection electrode 600 through the opening O and may be connected to the third external electrode 500.

In the exemplary embodiment, the opening O may expose a region of the connection electrode 600 disposed on the fifth surface 105 of the body 100. Thus, the connection electrode 600 and the shielding layer 810 may be in contact with and connected to each other on the fifth surface 105 of the body 100. As the opening O is formed on the fifth surface 105 of the body 100, the sixth surface 106 of the body may be disposed to face a lower portion, and a process for forming an external insulating layer, a process for forming an opening, and subsequent process (es) (e.g., a process for forming a shielding layer and a process for forming a cover layer) may be performed without altering directions of the body 100. Accordingly, in the subsequent processes, a process for distinguishing directions of the body 100 may be omitted.

FIGS. 3 and 7 illustrate an example in which the opening O is formed in quadrangular form, but an example of a shape of the opening O is not limited thereto. The opening O may have other various shapes such as a polygonal shape, and the like, as well as a circular shape, an oval shape, and a quadrangular shape.

The shielding layer 810 may include a cap portion 815 disposed on the fifth surface 105 of the body 100, and first to fourth side wall portions 811, 812, 813, and 814 respectively disposed on the first to fourth surfaces 101, 102, 103, and 104 of the body 100. The shielding layer 810 may be disposed on surfaces of the body 100 other than the sixth surface 106 of the body 100 and may reduce magnetic flux leakage of the coil component 1000.

In the exemplary embodiment, the cap portion 815 may be formed as a conformal film along the connection electrode 600 and the external insulating layer 700. Thus, the cap portion 815 may have a groove corresponding to the opening O.

One end of each of the side wall portions 811, 812, 813, and 814 may be connected to the cap portion 815, and the other ends of the side wall portions 811, 812, 813, and 814 may not extend to lower surfaces and internal walls of the recesses R. When the side wall portions 811, 812, 813, and 814 are formed through a sputtering process, the other ends of the side wall portions 811, 812, 813, and 814 may not extend onto the lower surfaces and the internal walls of the recesses R due to a low step coverage of the sputtering process. However, an exemplary embodiment thereof is not limited thereto. As another example, the other ends of the side wall portions 811, 812, 813, and 814 may extend onto the lower surfaces and the internal walls of the recesses R, and portions of the side wall portions 811, 812, 813, and 814 formed on the lower surfaces and the internal walls of the recesses R may be removed. As the other ends (e.g., lower ends) of the side wall portions 811, 812, 813, and 814 are not disposed on the lower surfaces and the internal walls of the recesses R, electrical shorts may be prevented between the shielding layer 810 and the first and second external electrodes 300 and 400.

The cap portion 815 may be integrated with the side wall portions 811, 812, 813, and 814. In other words, the cap portion 815 and the side wall portions 811, 812, 813, and 814 may be formed in the same process such that no boundary may be formed therebetween. As an example, the cap portion 815 and the side wall portions 811, 812, 813, and 814 may be integrated with each other by forming the shielding layer 810 on the first to fifth surfaces 101, 102, 103, 104, and 105 of the body 100 on which the external insulating layer 700 is formed, through a vapor deposition process such as a sputtering process. When forming the shielding layer 810 through a sputtering process, the shielding layer 810 may not be formed on lower surfaces and internal walls of the recesses R due to a low step coverage of the sputtering process.

The shielding layer 810 may include at least one of a conductive material and a magnetic material. For example, the conductive material may be a metal or an alloy including one or more materials selected from a group consisting of copper (Cu), aluminum (Al), iron (Fe), silicon (Si), boron (B), chromium (Cr), niobium (Nb), nickel (Ni), or alloys thereof, or may be Fe—Si or Fe—Ni. The shielding layer 810 may also include one or more materials selected from a group consisting of a ferrite, a permalloy, and an amorphous ribbon.

The shielding layer 810 may include two or more separate fine structures. For example, when the cap portion 815 and the side wall portions 811, 812, 813, and 814 each are formed of an amorphous ribbon sheet divided into a plurality of pieces isolated from one another, the cap portion 815 and the side wall portions 811, 812, 813, and 814 each may include a plurality of fine structures isolated from one another.

The shielding layer 810 may have a thickness of 10 nm to 100 μm. When a thickness of the shielding layer 810 is less than 10 nm, no or limited EMI shielding effect may be implemented, and when a thickness of the shielding layer 810 is greater than 100 μm, an overall length, width, and thickness of the coil component may increase such that it may be difficult to reduce a size of the coil component.

The cover layer 900 may be disposed on the shielding layer 810 to cover the shielding layer 810 and may be in contact with the external insulating layer 700. In other words, the cover layer 900 may bury the shielding layer 810 in the cover layer 900 along with the external insulating layer 700. Thus, the cover layer 900 may be disposed on the first to fifth surfaces 101, 102, 103, 104, and 105 of the body 100, and internal walls and lower surfaces of the recesses R, similarly to the external insulating layer 700. The cover layer 900 may prevent the shielding layer 810 from being electrically connected to external electronic components.

The cover layer 900 may include at least one of a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and SiOx or SiNx.

The cover layer 900 may be formed by layering a cover film such as a dry film (DF) on the body 100 on which the shielding layer 810 is formed. Alternatively, the cover layer 900 may be formed by forming an insulating material on the body 100 on which the shielding layer 810 is formed through a vapor deposition process such as a chemical vapor deposition (CVD) process, or the like.

The cover layer 900 may have a thickness of 10 nm to 100 μm. When a thickness of the cover layer 900 is less than 10 nm, insulating properties may be weakened such that electrical shorts may occur between the shielding layer 810 and the external electronic components, and when a thickness of the cover layer 900 is greater than 100 μm, an overall length, width, and thickness of the coil component may increase, and it may be difficult to reduce a size of the coil component.

A sum of thicknesses of the external insulating layer 700, the shielding layer 810, and the cover layer 900 may be greater than 30 nm, and may be 100 μm or lower. When a sum of thicknesses of the external insulating layer 700, the shielding layer 810, and the cover layer 900 is less than 30 nm, the issues such as electrical shorts, reduction of properties of a coil component such as a Q factor, and the like, may occur, whereas, when a sum of thicknesses of the external insulating layer 700, the shielding layer 810, and the cover layer 900 is greater than 100 μm, an overall length, width, and thickness of the coil component may increase, and it may be difficult to reduce a size of the coil component.

Although not illustrated, in the exemplary embodiment, the coil component may further include an insulating film formed along surfaces of the lead-out portions 231 and 232, the coil patterns 211 and 212, the internal insulating layer IL, and the auxiliary lead-out portions 241 and 242. The insulating film may protect the lead-out portions 231 and 232, the coil patterns 211 and 212, and the auxiliary lead-out portions 241 and 242, and may insulate the lead-out portions 231 and 232, the coil patterns 211 and 212, and the auxiliary lead-out portions 241 and 242 from the body 100, and may include a well-known insulating material such as a parylene, and the like. A material included in the insulating film may not be limited to any particular material. The insulating film may be formed through a vapor deposition process, and the like, but an example of the insulating film is not limited thereto. The insulating film may be formed by layering the insulating film on both surfaces of the internal insulating layer IL.

Also, in the exemplary embodiment, the coil component 1000 may further include an additional insulating layer distinct from the external insulating layer 700 and formed on and being in contact with at least one of the first to sixth surfaces 101, 102, 103, 104, 105, and 106 of the body 100. As an example, the additional insulating layer may be formed on the sixth surface 106 of the body 100, and the pad portions 320, 420, and 520 of the external electrodes 300, 400, and 500 may extend onto a lower surface of the additional insulating layer from the connection portions 310, 410, and 510 disposed on internal walls of the recesses R through side surfaces of the additional insulating layer. The additional insulating layer may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like, a photosensitive resin, a parylene, and SiOx or SiNx.

The external insulating layer 700 and the cover layer 900 may be directly disposed in the coil component, and may thus be different from a molding material molding the coil component and a printed circuit board during a process of mounting the coil component on the printed circuit board. As an example, the external insulating layer 700 and the cover layer 900 may not be in contact with a printed circuit board differently from a molding material. Also, the external insulating layer 700 and the cover layer 900 may not be supported by or fixed to a printed circuit board, differently from a molding material. In fact, the external insulating layer 700 and the cover layer 900 may remain spaced apart from a printed circuit board, and may be spaced apart from a lower surface of the external electrodes 300, 400, and 500. Further, differently from a molding material surrounding a connection member such as a solder ball which connects a coil component to a printed circuit substrate, the external insulating layer 700 and the cover layer 900 may not surround a connection member. Also, as the external insulating layer 700 and the cover layer 900 are not molding materials formed by heating an epoxy molding compound, and the like, flowing the heated epoxy molding compound onto a printed circuit board, and performing a curing process, it may not be necessary to consider a void occurring during a process of forming a molding material, or warpage of a printed circuit board caused by a difference in coefficients of thermal expansion between a molding material and a printed circuit board.

The shielding layer 810 may be directly disposed in the coil component in the exemplary embodiment, and thus, the shielding layer 810 may be different from a shielding can, which is coupled to a printed circuit board to shield EMI, and the like, after mounting the coil component on a printed circuit board. For example, as the shielding layer 810 is directly formed in the coil component, when the coil component is fixed to a printed circuit board by a solder, and the like, the shielding layer 810 may also be fixed to the printed circuit board, whereas a shielding can needs to be fixed to a printed circuit board independently from a coil component.

Accordingly, the coil component 1000 according to the exemplary embodiment may effectively shield magnetic flux leakage occurring in the coil component by directly forming the shielding layer 810 in the coil component. In other words, as electronic devices have been reduced in size and have higher performances, the number of electronic components included in an electronic device and a distance between adjacent electronic components have been recently reduced. In the exemplary embodiment, each coil component may be shielded such that magnetic flux leakage occurring in coil components may be shielded effectively, thereby reducing sizes of electronic components and implementing high performance. Further, in the coil component 1000 in the exemplary embodiment, the amount of an effective magnetic material may be increased in a shielding region as compared to a configuration in which a shielding can is used, thereby improving properties of the coil component.

Also, in the coil component 1000 in the exemplary embodiment, an electrode structure may easily be implemented on a lower portion while substantially maintaining a size of the coil component. In other words, differently from the related art, the external electrodes 300, 400, and 500 may not be disposed on both the front and rear surfaces 101 and 102 or both side surfaces 103 and 104 of the body 100, and thus, an increase of a length and a width of the coil component 1000 caused by the connection electrode 600, the external insulating layer 700, the shielding layer 810, and the cover layer 900 may be alleviated to some extent. Also, as the external electrodes 300, 400, and 500 have relatively reduced thicknesses, an overall thickness of the coil component 100 may be reduced.

Further, in the exemplary embodiment, a contact area between the first and second external electrodes 300 and 400 and the lead-out portions 231 and 232 may increase by the recesses R, thereby improving component reliability. Also, as surface roughness of one surfaces of the lead-out portions 231 and 232 exposed to the recesses R are relatively high, cohesion force between the lead-out portions 231 and 232 and the first and second external electrodes 300 and 400 may improve.

Second Embodiment

Figure 11:
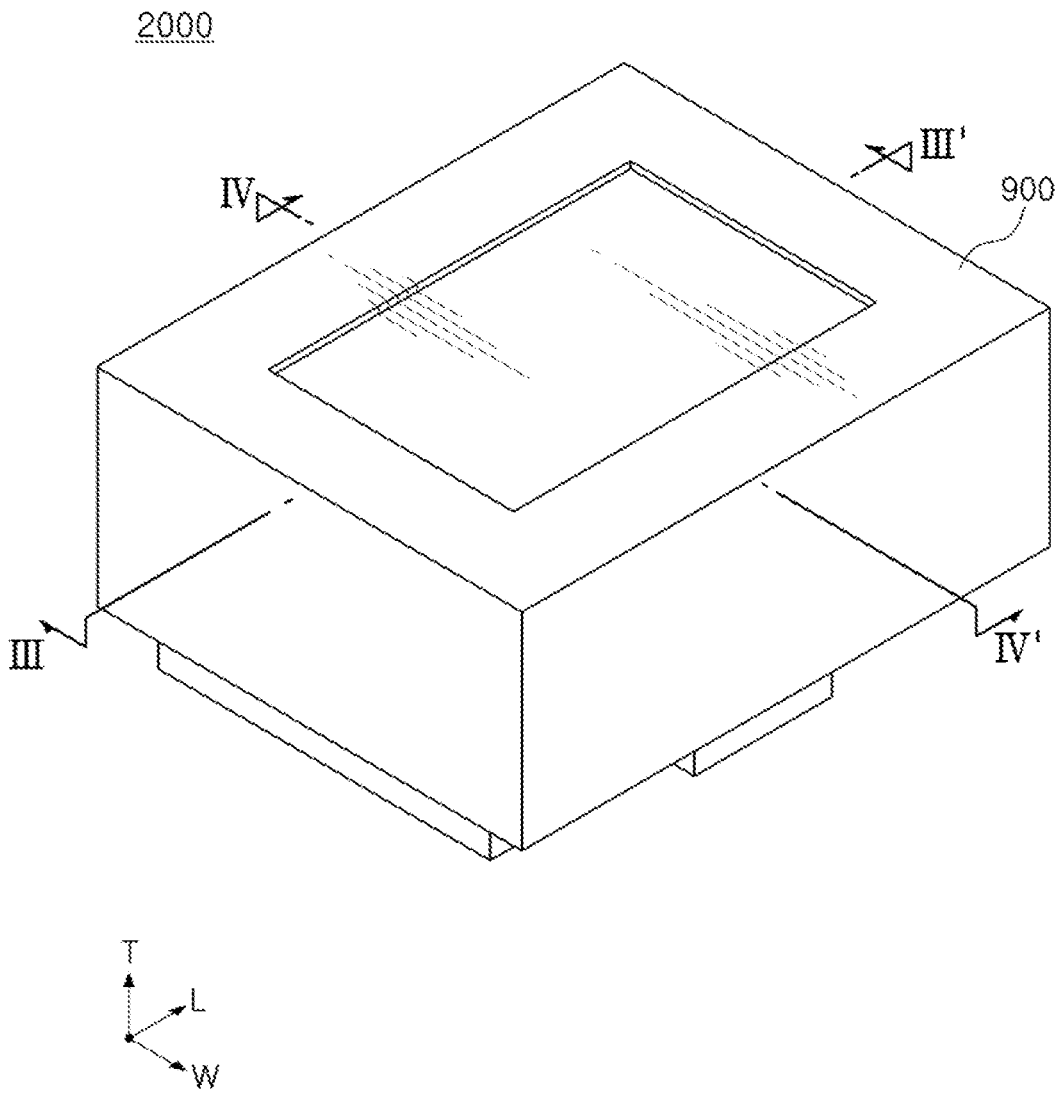
FIG. 11 is a schematic diagram illustrating a coil component according to another exemplary embodiment in the present disclosure.
Figure 12:
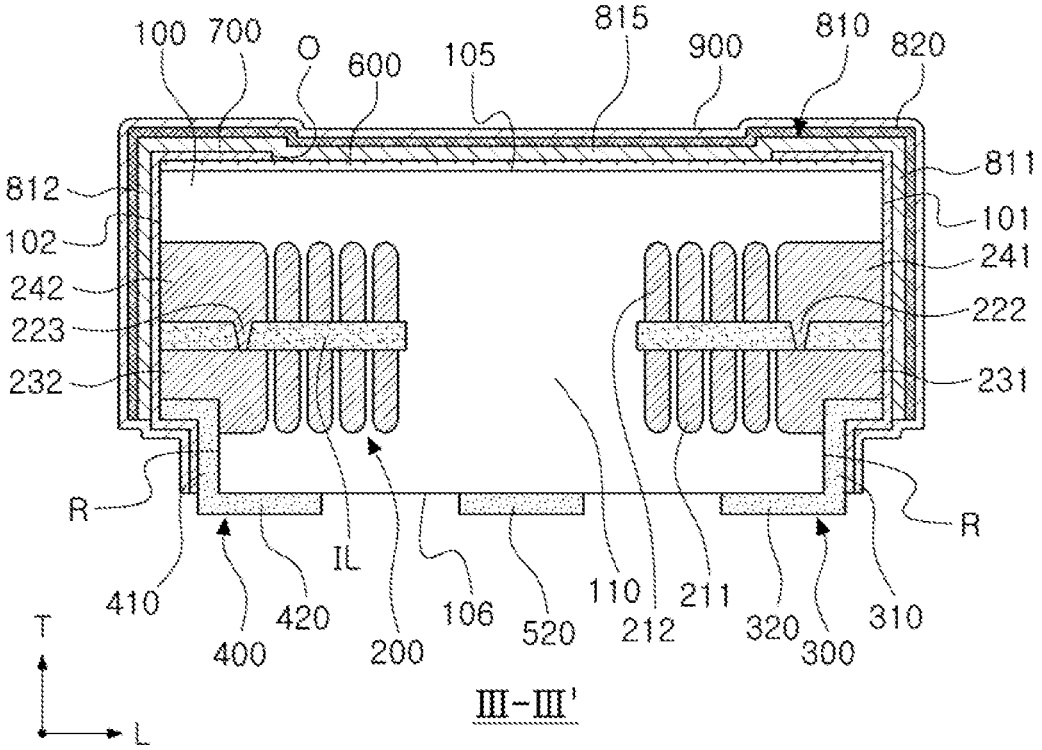
FIG. 12 is a cross-sectional diagram taken along line III-III' in FIG. 11.
Figure 13:
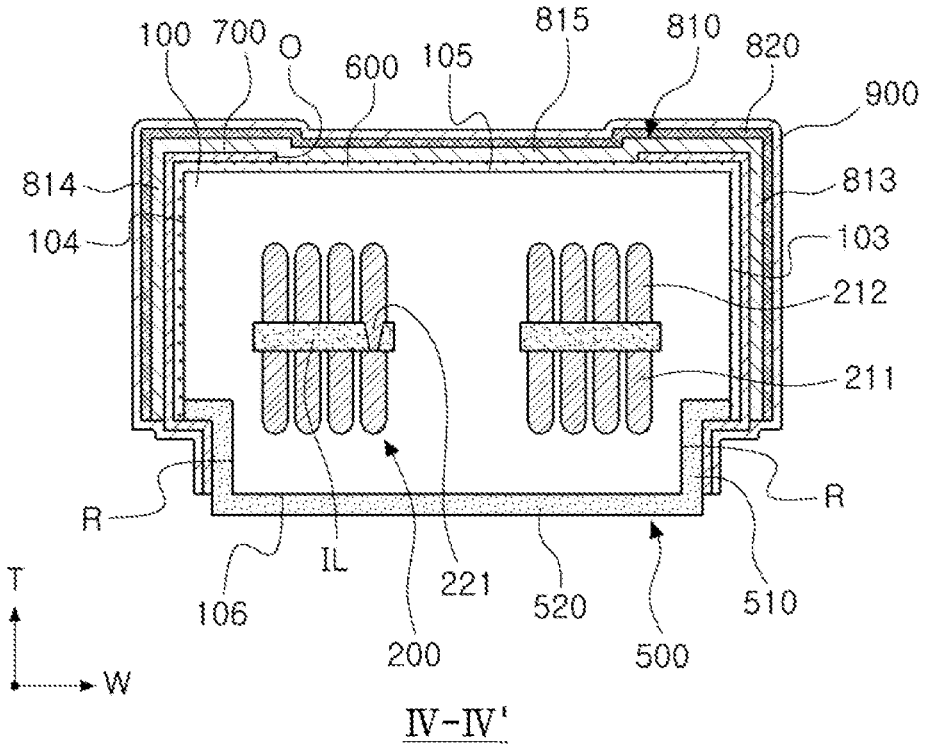
FIG. 13 is a cross-sectional diagram taken along line IV-IV' in FIG. 11.

FIG. 11 is a schematic diagram illustrating a coil component according to another exemplary embodiment. FIG. 12 is a cross-sectional view taken along line III-III' in FIG. 11. FIG. 13 is a cross-sectional view taken along line IV-IV' in FIG. 11.

Referring to FIGS. 1 to 13, in a coil component 2000 according to the exemplary embodiment, shielding layers 810 and 820 may be different from the shielding layer in the coil component 1000 described in the aforementioned exemplary embodiment. Thus, in the exemplary embodiment, only the shielding layers 810 and 820 will be described, which are different from the shielding layer in the aforementioned exemplary embodiment. The descriptions of the other elements in the exemplary embodiment will be the same as the descriptions in the aforementioned exemplary embodiment.

Referring to FIGS. 11 to 13, in the exemplary embodiment, the shielding layers 810 and 820 may include the first shielding layer 810 and the second shielding layer 820. The first shielding layer 810 may include a conductive material, and may be disposed on the external insulating layer 700 and in an opening O. The second shielding layer 820 may include a magnetic material, and may be disposed on the first shielding layer 810. In the exemplary embodiment, the shielding layers 810 and 820 may include a plurality of shielding layers.

The second shielding layer 820 may be in contact with the first shielding layer 810, and thus, electrical energy accumulated in the second shielding layer 820 may be discharged to a ground of a printed circuit board, and the like, through the first shielding layer 810, a connection electrode 600, and a third external electrode 500.

FIGS. 12 and 13 illustrate an example in which the second shielding layer 820 including a magnetic material is disposed externally of the first shielding layer 810 including a conductive material, but an exemplary embodiment thereof is not limited thereto. In other words, differently from the example in FIGS. 12 and 13, the shielding layer including a magnetic material may be disposed internally of the shielding layer including a conductive material.

In the exemplary embodiment, both of a reflective shielding effect by the first shielding layer 810 including a conductive material and an absorption shielding effect by the second shielding layer 820 including a magnetic material may be implemented. In other words, in a lower frequency band of 1 MHz or lower, magnetic flux leakage may be absorbed and shielded using the second shielding layer 820, and in a high frequency band higher than 1 MHz, magnetic flux leakage may be reflected and shielded using the first shielding layer 810. Thus, the coil component 2000 according to the exemplary embodiment may shield magnetic flux leakage in a relatively broad frequency band.

Third Embodiment

Figure 14:
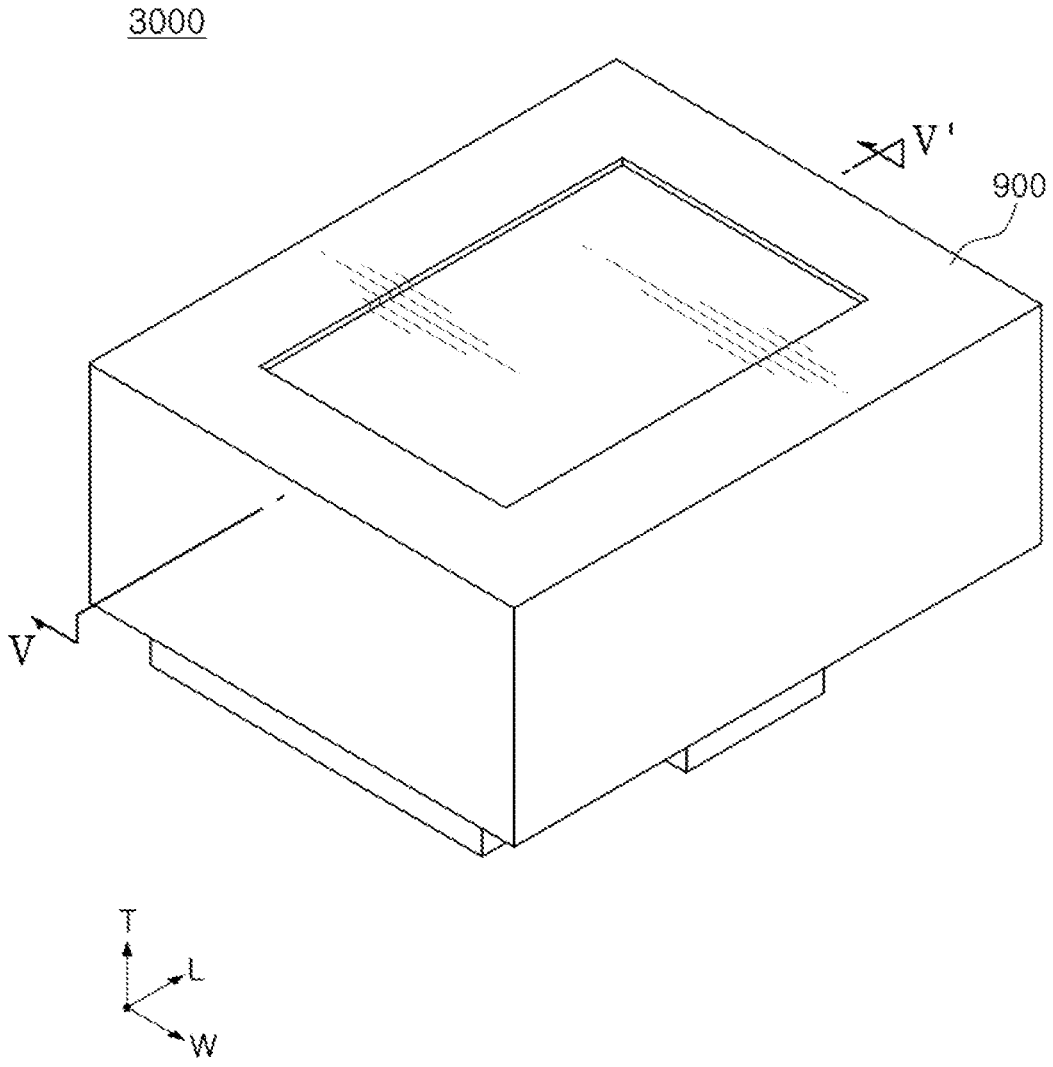
FIG. 14 is a schematic diagram illustrating a coil component according to another exemplary embodiment in the present disclosure.
Figure 15:
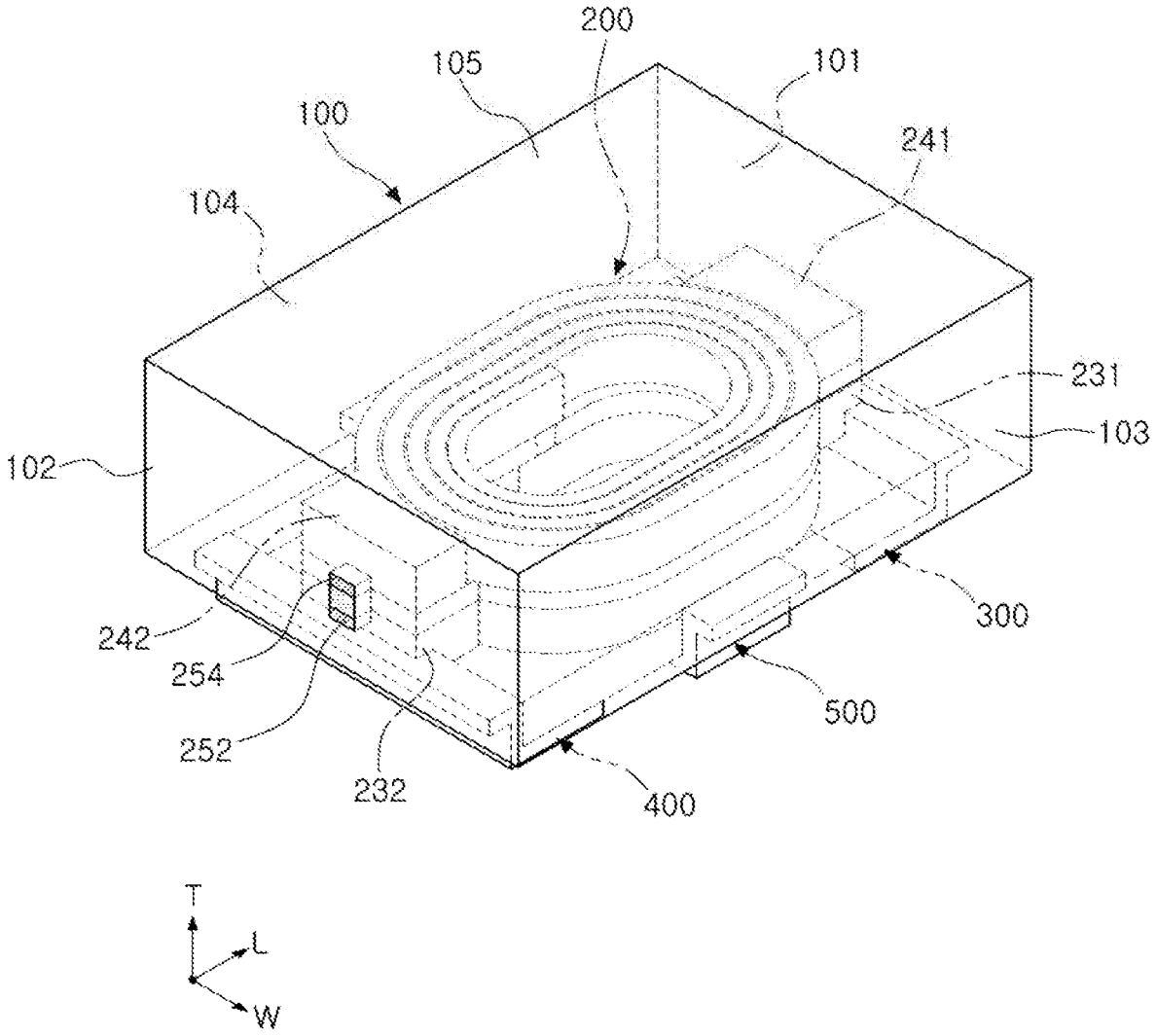
FIG. 15 is a diagram illustrating a coil component in which some of elements illustrated in FIG. 14 are omitted or translucent.
Figure 16:
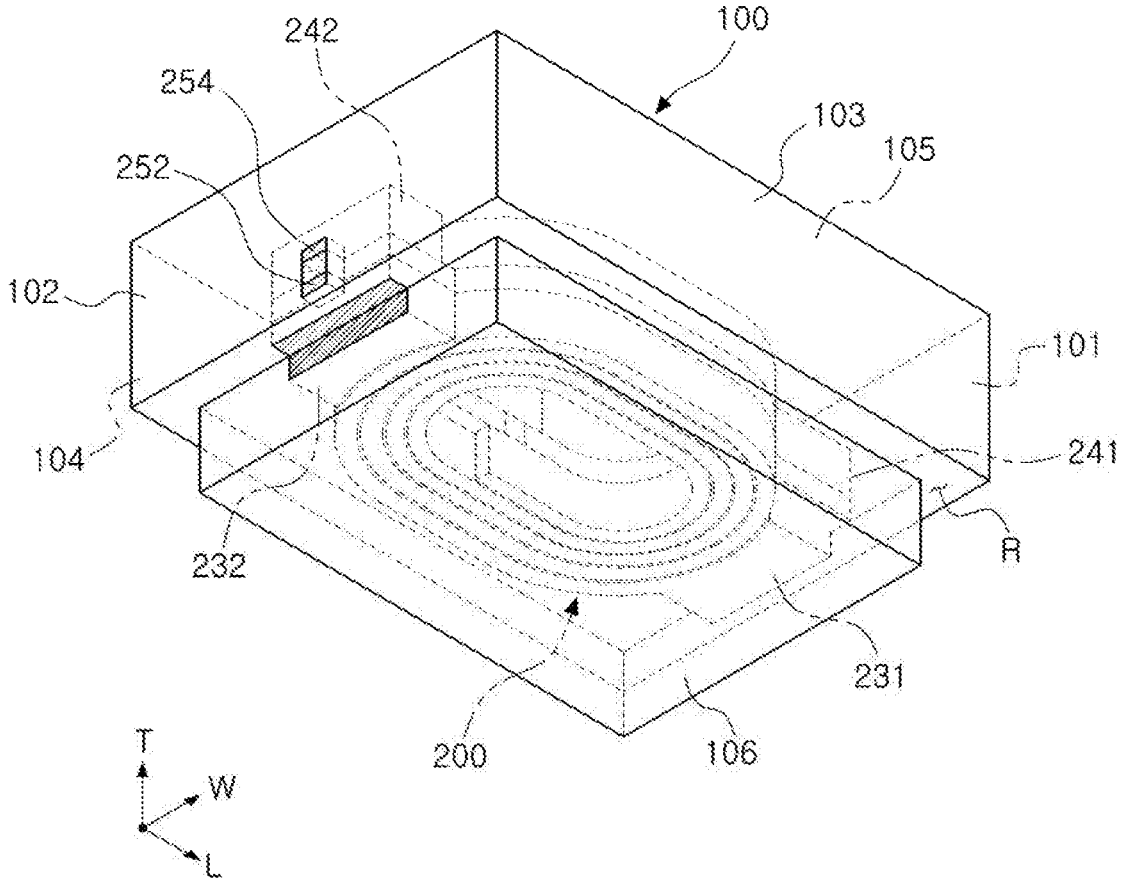
FIG. 16 is a diagram illustrating a coil component in which some of elements illustrated in FIG. 15 are omitted or translucent, viewed from a lower portion direction.
Figure 17:
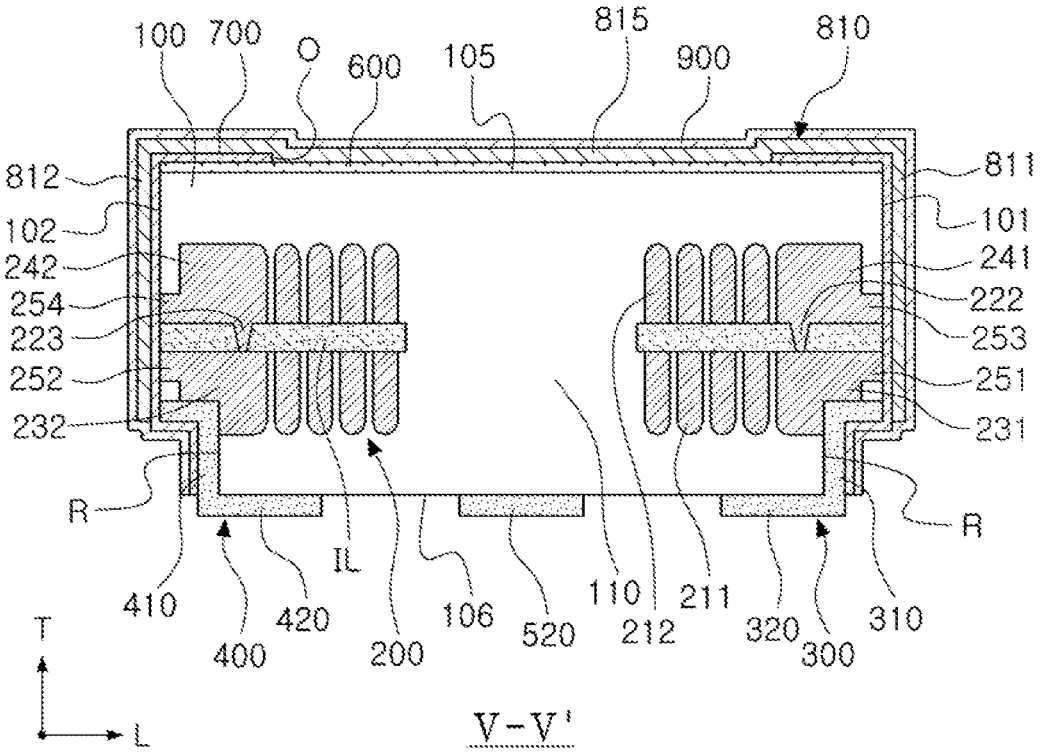
FIG. 17 is a cross-sectional diagram taken along line V-V' in FIG. 14.

FIG. 14 is a schematic diagram illustrating a coil component according to another exemplary embodiment. FIG. 15 is a diagram illustrating a coil component in which some of elements illustrated in FIG. 14 are omitted or translucent. FIG. 16 is a diagram illustrating a coil component illustrated in FIG. 15, viewed from a lower portion direction. FIG. 17 is a cross-sectional view taken along line V-V' in FIG. 14.

With regard to FIG. 15, FIG. 15 illustrates a coil component illustrated in FIG. 14, where a cover layer, a shielding layer, an insulating layer, and a connection electrode are omitted. FIG. 16 illustrates a coil component illustrated in FIG. 15, where an external electrode is omitted.

Referring to FIGS. 1 to 17, in a coil component 3000 according to the exemplary embodiment, a coil portion 200 may be different from the coil portions in the coil components 1000 and 2000 in the aforementioned exemplary embodiments. Thus, in the exemplary embodiment, only the coil portion 200 will be described, which is different from the coil portions in the aforementioned exemplary embodiments. The descriptions of the other elements in the exemplary embodiment will be the same as the descriptions in the aforementioned exemplary embodiments.

The coil portion 200 in the exemplary embodiment may further include cohesion reinforcing portions 251, 252, 253, and 254 respectively extending from lead-out portions 231 and 232 and auxiliary lead-out portions 241 and 242 and each exposed to one of the first and second surfaces 101 and 102 of the body 100. For example, the coil portion 200 may further include the first cohesion reinforcing portion 251 extending from the first lead-out portion 231 and exposed to the first surface 101 of the body 100, the second cohesion reinforcing portion 252 extending from the second lead-out portion 232 and exposed to the second surface 102 of the body 100, the third cohesion reinforcing portion 253 extending from the first auxiliary lead-out portion 241 and exposed to the first surface 101 of the body 100, and the fourth cohesion reinforcing portion 254 extending from the second auxiliary lead-out portion 242 and exposed to the second surface 102 of the body 100. In the exemplary embodiment, differently from the aforementioned exemplary embodiment, the lead-out portions 231 and 232 and the auxiliary lead-out portions 241 and 242 may not be exposed to the first and second surfaces 101 and 102 of the body 100, and the cohesion reinforcing portions 251, 252, 253, and 254 extending from the lead-out portions 231 and 232 and the auxiliary lead-out portions 241 and 242 to front and rear surfaces 101 and 102 of the body 100 may be exposed to the front and rear surfaces 101 and 102 of the body 100.

The cohesion reinforcing portions 251, 252, 253, and 254 may have widths smaller than widths of the lead-out portions 231 and 232 and the auxiliary lead-out portions 241 and 242, and/or may have thicknesses smaller than thicknesses of the lead-out portions 231 and 232 and the auxiliary lead-out portions 241 and 242. In other words, the cohesion reinforcing portions 251, 252, 253, and 254 may reduce volumes of ends of the coil portion 200 such that areas of the coil portion 200 exposed to the first and second surfaces 101 and 102 of the body 100 may be significantly reduced.

Accordingly, in the coil component 3000 in the exemplary embodiment, cohesion force between the ends of the coil portion 200 and the body 100 may improve. In other words, by disposing the cohesion reinforcing portions 251, 252, 253, and 254 having volumes less than volumes of the lead-out portions 231 and 232 and the auxiliary lead-out portions 241 and 242 of the coil portion 200 on an outermost portion of the body 100, a volume of the outermost portion of the body 100 may increase.

Further, in the coil component 3000 in the exemplary embodiment, by improving an effective volume of a magnetic material, degradation of component properties may be prevented.

Also, in the coil component 3000 in the exemplary embodiment, by reducing areas of the coil portion 200 exposed to front and read surfaces 101 and 102 of the body 100, electrical shorts may be prevented.

In the exemplary embodiment, a plurality of the cohesion reinforcing portions 251, 252, 253, and 254 may be provided in the lead-out portions 231 and 232 and the auxiliary lead-out portions 241 and 242. For example, at least one of the first cohesion reinforcing portion 251 extending from the first lead-out portion 231 and exposed to the first surface 101 of the body 100, the second cohesion reinforcing portion 252 extending from the second lead-out portion 232 and exposed to the second surface 102 of the body 100, the third cohesion reinforcing portion 253 extending from the first auxiliary lead-out portion 241 and exposed to the first surface 101 of the body 100, and the fourth cohesion reinforcing portion 254 extending from the second auxiliary lead-out portion 242 and exposed to the second surface 102 of the body 100 may be provided as a plurality of cohesion reinforcing portions.

Accordingly, a contact area between the coil portion 200 and the body 100 may increase such that cohesion force therebetween may be improved.

Fourth Embodiment

Figure 18:
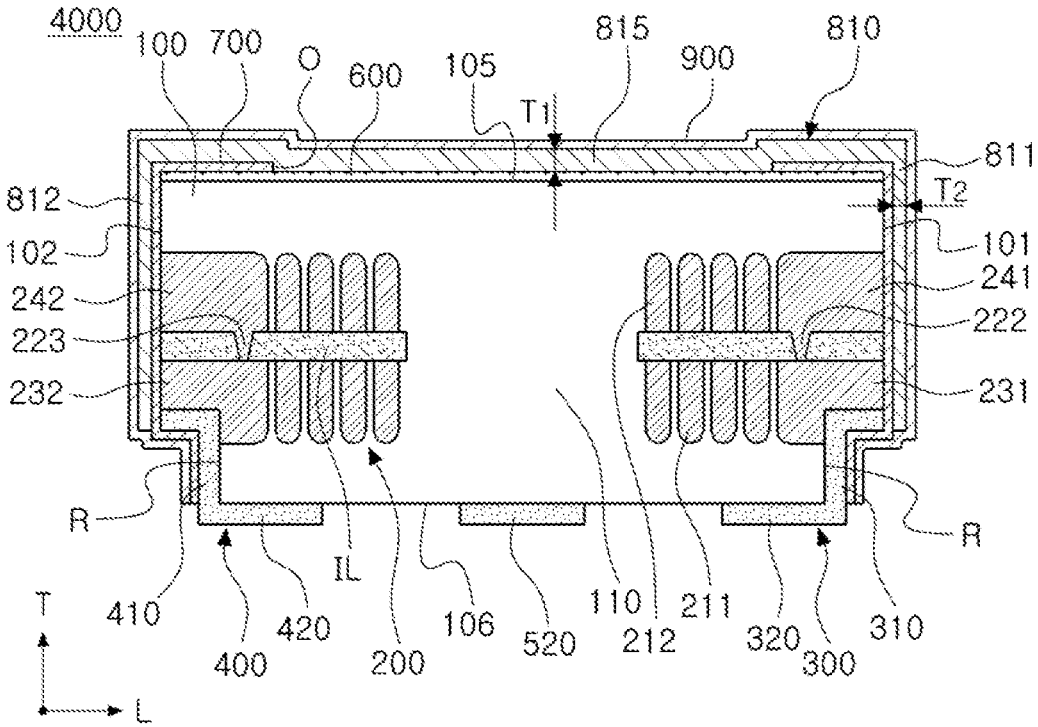
FIG. 18 is a cross-sectional diagram of a coil component according to another exemplary embodiment in the present disclosure, corresponding to a cross-section taken along line I-I' in FIG. 1.

FIG. 18 is a cross-sectional diagram of a coil component according to another exemplary embodiment, and FIG. 18 corresponds to a cross-section taken along line I-I' in FIG. 1.

Referring to FIGS. 1 to 18, in a coil component 4000 according to the exemplary embodiment, a cap portion 815 and side wall portions 811, 812, 813, and 814 may be different from the cap portion and the side wall portions in the coil components 1000, 2000, and 3000 in the aforementioned exemplary embodiments. Thus, in the exemplary embodiment, only the cap portion 815 and the side wall portions 811, 812, 813, and 814 will be described, which are different from the cap portion and the side wall portions in the aforementioned exemplary embodiments. The descriptions of the other elements in the exemplary embodiment will be the same as the descriptions in the aforementioned exemplary embodiments.

Referring to FIG. 18, a thickness of the cap portion 815 may be greater than thicknesses of the side wall portions 811, 812, 813, and 814.

Coil patterns 211 and 212 of a coil portion 200 may form a plurality of turns towards an outer portion of an internal insulating layer IL from a central portion of the internal insulating layer IL on both surfaces of the internal insulating layer IL, and the coil patterns 211 and 212 may be layered in a thickness direction T of the body 100 and connected to each other through a via 221. Accordingly, magnetic flux occurring in the thickness direction T of the body 100 may be greater than magnetic fluxes occurring in other directions.

Thus, by configuring thicknesses of the portions of the cap portion 815 disposed on the fifth surface of the body 100 perpendicular to the thickness direction T of the body 100 to be greater than thicknesses of the side wall portions 811, 812, 813, and 814 (measured orthogonally to the corresponding side wall portion 811, 812, 813, and 814) disposed on walls of the body 100, magnetic flux leakage may be reduced effectively.

For example, a temporary shielding layer may be formed on first to fifth surfaces of the body 100 using a shielding sheet including an insulating film and a shielding film, and a shielding material may be additionally formed only on the fifth surface of the body 100, thereby forming a thickness of the cap portion 815 to be greater than thicknesses of the side wall portions 811, 812, 813, and 814. As another example, the body 100 may be disposed such that the fifth surface of the body 100 opposes a target, and a sputtering process for forming a shielding layer 500 may be performed, thereby forming a thickness of the cap portion 815 to be greater than thicknesses of the side wall portions 811, 812, 813, and 814. However, an exemplary embodiment thereof is not limited thereto.

Accordingly, in the coil component 4000 according to the exemplary embodiment, magnetic flux leakage may be reduced effectively in consideration of a direction of a magnetic field formed by the coil portion 200.

According to the aforementioned exemplary embodiments, a size of a coil component may be reduced.

Also, according to the aforementioned exemplary embodiments, an electrode structure may easily be formed on a lower surface.

Further, a shielding structure may easily be formed.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having one surface and another surface opposing each other, front and rear surfaces connecting the one surface and the another surface and opposing each other, and side surfaces connecting the both front and rear surfaces and opposing each other;

a coil portion disposed in the body, and including first and second lead-out portions;

recesses disposed along respective edges of the one surface of the body, and exposing the first and second lead-out portions to internal walls and lower surfaces of the recesses;

first and second external electrodes respectively disposed in the recesses and spaced apart from each other, and connected to the first and second lead-out portions, respectively;

a third external electrode disposed in the recesses, and spaced apart from the first and second external electrodes;

a connection electrode disposed on at least a portion of the side surfaces of the body and on the another surface of the body, and connected to the third external electrode;

an external insulating layer covering the connection electrode, and having an opening exposing at least a portion of the connection electrode; and a shielding layer disposed on the external insulating layer and in the opening and connected to the connection electrode.

2. The coil component of claim 1, wherein the first, second, and third external electrodes each include a connection portion respectively disposed on the lower surfaces of the recesses and the internal walls of the recesses, and a pad portion connected to the connection portion and disposed on the one surface of the body.

3. The coil component of claim 2, wherein the first, second, and third external electrodes are each formed in integrated form respectively along the lower surfaces of the recesses, the internal walls of the recesses, and the one surface of the body.

4. The coil component of claim 2, wherein the external insulating layer is disposed on the another surface, the side surfaces, and the front and rear surfaces of the body, and extends onto lower surfaces and internal walls of the recesses to cover the connection portions.

5. The coil component of claim 1, wherein surfaces of the first and second lead-out portions are respectively exposed to the recesses and have surface roughness higher than surface roughness of surfaces of the first and second lead-out portions other than the surfaces of the first and second lead-out portions exposed to the recesses.

6. The coil component of claim 1, further comprising:

a cover layer covering the shielding layer.

7. The coil component of claim 1, wherein the shielding layer includes at least one of a conductive material and a magnetic material.

8. The coil component of claim 1, wherein the shielding layer includes a first shielding layer including a conductive material and disposed on the external insulating layer and in the opening, and a second shielding layer including a magnetic material and disposed on the first shielding layer.

9. The coil component of claim 1, wherein the opening exposes a region of the connection electrode disposed on the another surface of the body.

10. The coil component of claim 1, wherein the shielding layer further includes a cap portion disposed on the another surface of the body, and side wall portions connected to the cap portion, and disposed on front and rear surfaces and side surfaces of the body.

11. The coil component of claim 10, wherein the cap portion has a thickness greater than thicknesses of the side wall portions.

12. The coil component of claim 1, further comprising:

an internal insulating layer disposed in the body, wherein the first and second lead-out portions are disposed on one surface of the internal insulating layer facing the one surface of the body, and are spaced apart from each other.

13. The coil component of claim 12, wherein the coil portion further includes a first coil pattern disposed on the one surface of the internal insulating layer, in contact with the first lead-out portion, and spaced apart from the second lead-out portion, a second coil pattern disposed on another surface of the internal insulating layer opposing the one surface of the internal insulating layer, and a via penetrating through the internal insulating layer to connect the first coil pattern and the second coil pattern.

14. The coil component of claim 13, wherein the coil portion further includes first and second auxiliary lead-out portions disposed on the another surface of the internal insulating layer and spaced apart from each other, wherein the first auxiliary lead-out portion is spaced apart from the second coil pattern and the second auxiliary lead-out portion, and wherein the second auxiliary lead-out portion is in contact with the second coil pattern.

15. The coil component of claim 14, wherein the coil portion further includes cohesion reinforcing portions each extending from one of the first and second lead-out portions and the first and second auxiliary lead-out portions, and each exposed to a respective one of the front and rear surfaces of the body.

16. The coil component of claim 15, wherein the cohesion reinforcing portions each have a thickness lower than thicknesses of the first and second lead-out portions and the first and second auxiliary lead-out portions.

17. A coil component, comprising:

a body having one surface and another surface opposing each other, and a plurality of walls connecting the one surface and the another surface;

a coil portion disposed in the body;

recesses disposed along respective edges of the one surface of the body, and exposing respective ends of the coil portion in internal walls and lower surfaces of the recesses;

first and second external electrodes disposed on the one surface of the body and spaced apart from each other, and extending to the recesses to be connected to a respective end of the coil portion;

a third external electrode spaced apart from the first and second external electrodes, and disposed on the one surface of the body and in the recesses;

a connection electrode disposed on at least portions of the plurality of walls of the body and connected to the third external electrode;

an external insulating layer disposed on the another surface of the body, on each of the plurality of walls of the body, and on the recesses, and having an opening exposing at least a portion of the connection electrode; and a shielding layer disposed on the external insulating layer and in the opening and connected to the connection electrode.

18. A coil component comprising:

a body having first and second surfaces opposing each other in a first direction, third and fourth surfaces opposing each other in a second direction, and fifth and sixth surfaces opposing each other in a third direction;

a coil disposed in the body to be substantially parallel to the first surface and spaced apart from the first surface, and including first and second lead-out portions connected to respective ends of the coil;

recesses disposed along respective edges of the first surface and corresponding edges of the third, fourth, fifth, and sixth surfaces of the body;

a shielding layer disposed on second, third, fourth, fifth, and sixth surfaces of the body, and including at least one of a conductive material and a magnetic material; and first, second, and third external electrodes disposed in the recesses, connected to the first lead-out portion, the second lead-out portion, and the shielding layer, respectively, and disposed on the first surface of the body to be spaced apart from each other.

19. The coil component of claim 18, wherein the recesses disposed along the third and fourth surfaces of the body extend from one of the first and second lead-out portions to the first surface of the body.

20. The coil component of claim 18, wherein the recesses are free of the shielding layer.

21. The coil component of claim 18, wherein the third external electrode is disposed in the recesses disposed along the fifth and sixth surfaces of the body.

22. The coil component of claim 21, further comprising:

a connection electrode disposed on at least a portion of the fifth and sixth surfaces of the body and on the second surface of the body, and connected to the third external electrode; and an external insulating layer disposed on the second, third, fourth, fifth, and sixth surfaces of the body, covering the connection electrode, and having an opening exposing at least a portion of the connection electrode, wherein the shielding layer is disposed on the external insulating layer and contacts the connection electrode through the opening in the external insulating layer.

* * * * *